US007362875B2

(12) United States Patent
Saxton et al.

(10) Patent No.: US 7,362,875 B2
(45) Date of Patent: Apr. 22, 2008

(54) BALLOON-EXPANDABLE HEARING DEVICE FITTING SYSTEM AND SELF-EXPANDING HEARING DEVICE

(75) Inventors: Gary M. Saxton, Sunnyvale, CA (US); Ross S. Tsugita, Mountain View, CA (US); Jobert P. Balceta, San Jose, CA (US)

(73) Assignee: Sonic Innovations, Inc., Salt Lake City, UT (US)

( * ) Notice: Subject to any disclaimer, the term of this patent is extended or adjusted under 35 U.S.C. 154(b) by 655 days.

(21) Appl. No.: 10/817,329

(22) Filed: Apr. 2, 2004

(65) Prior Publication Data

US 2004/0258263 A1 Dec. 23, 2004

Related U.S. Application Data

(60) Provisional application No. 60/460,259, filed on Apr. 3, 2003.

(51) Int. Cl.
*H04R 25/00* (2006.01)

(52) U.S. Cl. ..... 381/322; 381/328

(58) Field of Classification Search ..... 381/312, 381/322, 324, 325, 328, 330; 181/129, 130, 181/134

See application file for complete search history.

(56) References Cited

U.S. PATENT DOCUMENTS

| | | | | |
|---|---|---|---|---|
| 3,097,059 | A | 7/1963 | Hoffman | |
| 3,197,577 | A | 7/1965 | Kuklock | |
| 3,208,102 | A | 9/1965 | Rubio | |
| 3,344,220 | A | 9/1967 | Cook | |
| 3,440,314 | A | 4/1969 | Frisch | |
| 3,513,269 | A | 5/1970 | Wilson | |
| 3,881,570 | A | 5/1975 | Lewis | |
| 4,006,796 | A | 2/1977 | Coehorst | |
| 4,539,440 | A | 9/1985 | Sciarra | |
| 4,962,537 | A | 10/1990 | Basel et al. | |
| 5,046,580 | A | 9/1991 | Barton | |
| 5,131,411 | A | 7/1992 | Casali et al. | |
| 5,203,352 | A | 4/1993 | Gardner, Jr. | |
| 5,455,994 | A | 10/1995 | Termeer et al. | |
| 6,022,311 | A | 2/2000 | Juneau et al. | |
| 6,094,494 | A | 7/2000 | Haroldson | |
| 6,135,235 | A * | 10/2000 | Brimhall | 181/135 |
| 6,253,871 | B1 | 7/2001 | Aceti | |
| 6,256,396 | B1 | 7/2001 | Cushman | |
| 2002/0087094 | A1 | 7/2002 | Schmid | |
| 2004/0215053 | A1 * | 10/2004 | Jorgensen et al. | 600/25 |

FOREIGN PATENT DOCUMENTS

| | | | |
|---|---|---|---|
| EP | 1 272 003 | A1 | 1/2003 |

OTHER PUBLICATIONS

PCT/US2004/010464 International Search Report, no date.

* cited by examiner

*Primary Examiner*—Curtis Kuntz
*Assistant Examiner*—Tuan D Nguyen
(74) *Attorney, Agent, or Firm*—Holland & Hart

(57) ABSTRACT

A self-expanding hearing device is disclosed. The device includes a body, a membrane coupled to the body, and a frame coupled to the body, so that a user can compress the frame for insertion into the user's ear canal, and when the user releases compression the frame expands so that the device is lodged in the ear canal.

67 Claims, 25 Drawing Sheets

Fig. 32
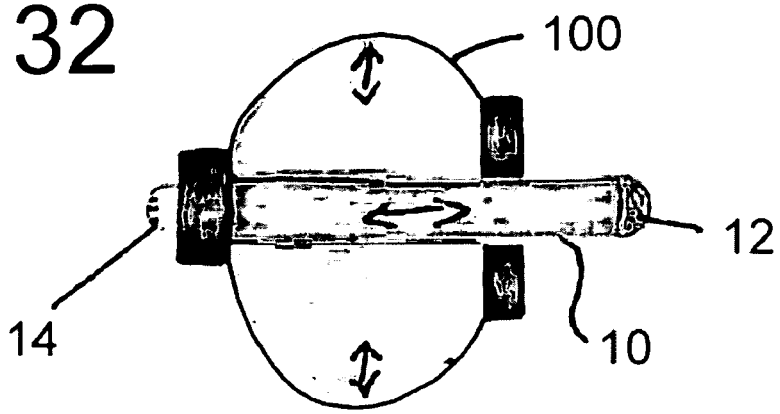
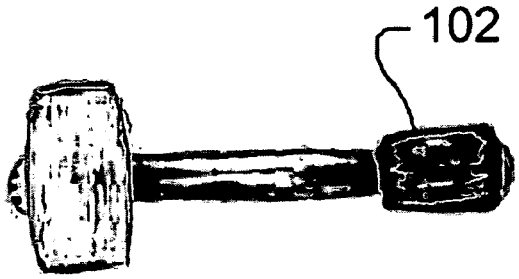
Fig. 33
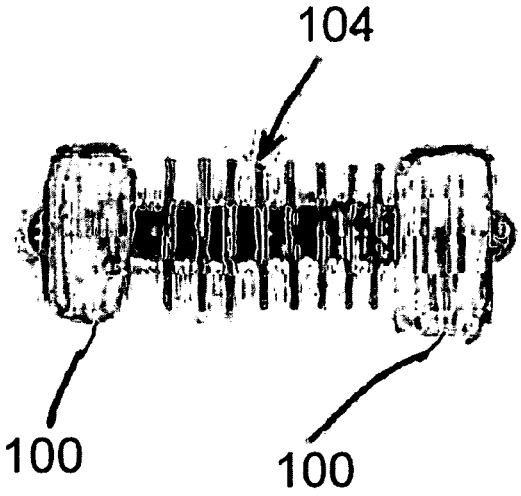
Fig. 34

BALLOON-EXPANDABLE HEARING DEVICE FITTING SYSTEM AND SELF-EXPANDING HEARING DEVICE

CROSS REFERENCE TO RELATED APPLICATION

This application claims the benefit of U.S. Provisional Patent Application Ser. No. 60/460,259, filed Apr. 3, 2003 in the name of the inventor, Gary Saxton.

FIELD OF THE INVENTION

The present invention pertains to hearing devices, including hearing aids.

BACKGROUND OF THE INVENTION

The modern trend in the design and implementation of hearing devices is focusing to a large extent on reducing the physical size of the hearing device. Miniaturization of hearing device components is becoming increasingly feasible with rapid technological advances in the fields of power supplies, sound processing electronics and micromechanics. The demand for smaller and less conspicuous hearing devices continues to increase as a larger portion of our population ages and faces hearing loss. Those who face hearing loss also encounter the accompanying desire to avoid the stigma and self consciousness associated with this condition. As a result, smaller hearing devices which are cosmetically less visible are increasingly sought after.

Hearing device technology has progressed rapidly in recent years. First generation hearing devices were primarily of the Behind-The-Ear (BTE) type, where an externally mounted device was connected by an acoustic tube to a molded shell placed within the ear. With the advancement of component miniaturization, modern hearing devices rarely use this Behind-The-Ear technique, focusing primarily on one of several forms of an In-The-Canal hearing device. Three main types of In-The-Canal hearing devices are routinely offered by audiologists and physicians. In-The-Ear (ITE) devices rest primarily in the concha of the ear and have the disadvantages of being fairly conspicuous to a bystander and relatively bulky to wear. Smaller In-The-Canal (ITC) devices fit partially in the concha and partially in the ear canal and are less visible but still leave a substantial portion of the hearing device exposed. Recently, Completely-In-The-Canal (CIC) hearing devices have come into greater use. As the name implicates, these devices fit deep within the ear canal and are essentially hidden from view from the outside.

In addition to the obvious cosmetic advantages these types of in-the-canal devices provide, they also have several performance advantages that larger, externally mounted devices do not offer. Placing the hearing device deep within the ear canal and proximate to the tympanic membrane (ear drum) improves the frequency response of the device, reduces distortion due to jaw extrusion, reduces the occurrence of the occlusion effect and improves overall sound fidelity.

The shape and structure, or morphology, of the ear canal varies from person to person. However, certain characteristics are common to all individuals. When viewed in the transverse plane, the path of the ear canal is extremely irregular, having several sharp bends and curves. It is these inherent structural characteristics which create problems for the acoustic scientist and hearing device designer.

For general discussion purposes, the ear canal can be broken into three main segments. The external and medial segments are both surrounded by a relatively soft cartilaginous tissue. The external segment is largely visible from the outside and represents the largest cavity of the ear canal. The innermost segment of the ear canal, closest to the tympanic membrane, is surrounded by a denser bony material and is covered with only a thin layer of soft tissue. The bony material allows for little expansion to occur in this region compared with the cartilaginous regions of the external and medial segments of the ear canal. In addition to being surrounded by cartilage rather than bone, these areas are covered with a substantially thicker tissue layer. As such, pressure exerted by an ITC hearing device on the inner bony region of the canal can lead to discomfort and/or pain to an individual, especially when a deep insertion technique is used.

Since the morphology of the ear canal varies so greatly from person to person, hearing aid manufacturers and audiologists have employed custom manufactured devices in order to precisely fit the dimensions of each user's ear canal. This frequently necessitates impressions of the user's ear canal to be taken. The resulting mold is then used to fabricate a rigid hearing device shell. This process is both expensive and time consuming and the resulting rigid device shell does not perform well during the deformations of the ear canal shape that occurs during normal jaw movement. In order to receive a properly fit hearing device, the user typically has to make several trips to the audiologist for reshaping and resizing. Even after the best possible fit is obtained, the rigid shell rarely provides comfortable hearing enhancement at all times.

Further, because the resulting hearing aid device shell is typically formed from a hard acrylic material, discomfort to the user is typical when worn for extended periods of time. The inability of the hard shell to conform to normal ear canal deformations can cause it to become easily dislodged from its proper position. Consequently, the quality of the hearing enhancement suffers. Furthermore, due to the added manufacturing costs, it is desirable to utilize a hearing device that is at least partially formed from an off-the-shelf or preformed component readily available to the audiologist or physician.

While the performance of CIC hearing devices are generally superior to other larger and less sophisticated devices, several problems remain prevalent. As mentioned above, the custom manufacture of CIC hearing devices is time consuming and expensive. Therefore improvement of the custom manufacturing process is desirable. Also, as mentioned, even custom manufactured devices can be uncomfortable to wear, especially for extended periods of time. Therefore devices which are more comfortable than the present devices are desirable.

BRIEF DESCRIPTION OF THE INVENTION

In accordance with a first aspect of the invention a self-expanding hearing device includes a body, a membrane coupled to the body; and a frame coupled to the body. The frame is flexible and resilient so that a user can compress the frame for insertion into the user's ear canal, and when the user releases compression the frame expands so that the device is lodged in the ear canal.

According to another aspect of the invention a kit for a balloon-expandable hearing device fitting system includes an occlusion wire, a balloon expander, ear gel, and a hearing aid.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

In the drawings:

FIG. 32 is a partially cut away view of another embodiment of a self-expanding hearing device according to the present invention.

FIG. 33 is a partially cut away view of another embodiment of a self-expanding hearing device according to the present invention.

FIG. 34 is a partially cut away view of another embodiment of a self-expanding hearing device according to the present invention.

DETAILED DESCRIPTION

Embodiments of the present invention are described herein in the context of a balloon-expandable hearing device fitting system and self-expanding hearing device.

Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application-and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
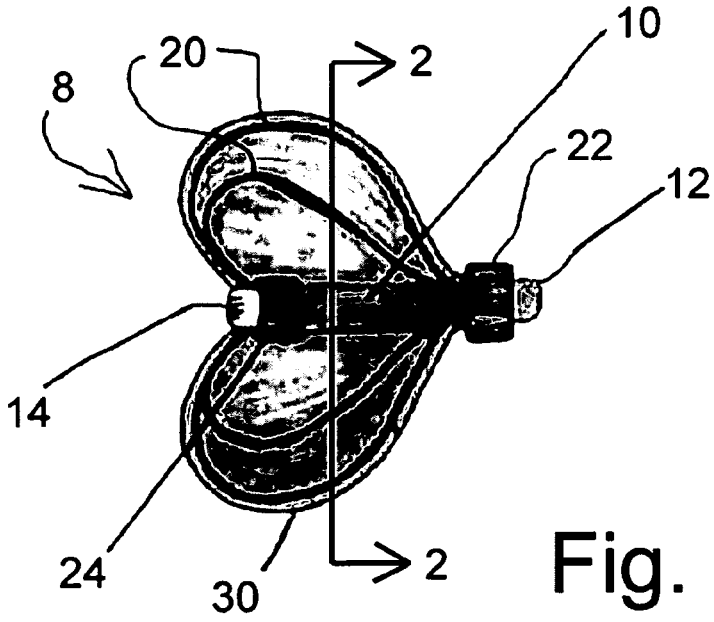
FIG. 1 is a partially cut away view of an embodiment of a self-expanding hearing device according to the present invention.
Figure 3:
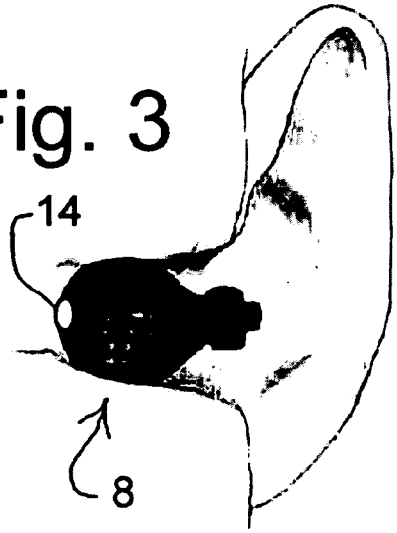
FIG. 3 is a view of the embodiment of FIG. 1 installed in the ear canal.
Figure 2:
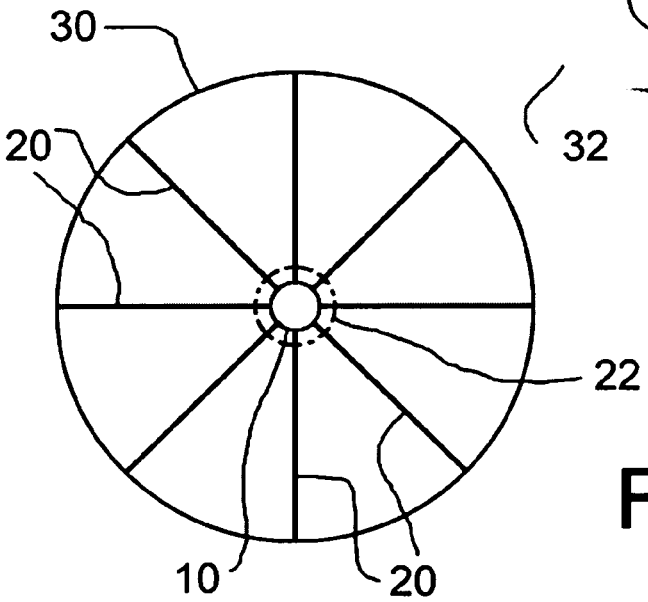
FIG. 2 is a sectional view of the embodiment of FIG. 1 taken along line 2-2.

FIGS. 1-3 illustrate an embodiment of the self-expanding in-the-canal hearing device 8. The device 8 comprises three basic components, a body, a membrane, and a frame.

The body 10 is tube shaped, and a conventional microphone 12 is mounted at the distal end while a conventional speaker 14 is mounted at the proximal end of the body 10. Conventional electronic components, not shown, are housed in the body 10 to process signals from the microphone and to drive the speaker 14. The body 10 is preferably made of plastic, although it may also be made of other materials such as Nitinol or stainless steel or other material. In the illustrated embodiment the body 10 is straight, although alternatively it may be flexible so that it can be shaped to best conform to the ear canal. As another alternative, the body 10 can be made from soft stainless steel that is malleable and can be bent during a fitting process to conform to the ear canal. As still another alternative, the body 10 can be made from Nitinol and formed with a pre-shaped bend so the body comprises a spring. The ear canal would deflect the preformed shape creating a spring effect so the hearing device "wedges" into place and is held in position. As yet another alternative, the body 10 can be constructed so that the user can form the body into an appropriate shape to conform to the user's ear canal, and the body will retain the formed shape.

The frame comprises eight supports 20 which are shaped as thin rods. Each support 20 is connected at its distal end to a distal connector 22, and at the proximal end each support 20 is connected to a proximal connector 24. The supports 20 are preferably constructed of metal and are flexible and resilient and act as springs. The supports 20 are longer than the distance between the proximal connector 24 and the distal connector 22 so that the supports 20 are deformed to be spaced apart from the body 10 throughout most of their length. The distal and proximal connectors 22 and 24 are affixed to the body 10 to hold the ends of the supports 20 in fixed engagement with the body. At the proximal end of the device, near the speaker 14, the supports 20 are connected to the proximal end of the proximal connector 24 so that as the supports 20 leave the connector 24 they extend proximally a short distance before bending to the distal direction. At the distal end of the device, near the microphone 12, the supports 20 are connected to the proximal end of the distal connector 24 so that as the supports 20 leave the connector 24 they extend proximally. The supports act as springs and are preferably constructed of metal such as Nitinol, Elgiloy, spring steel or MP35 alloy. Alternatively, however, for certain applications the supports can be constructed of other materials such as certain plastics. The supports are between 0.002 and 0.02 inches wide, and more preferably between 0.004 and 0.015 and more preferably between 0.005 and 0.01 inches wide.

The supports 20 can be constructed to assist the user in installing the device. For example, the supports 20 can be constructed of a shape memory material such as Nitinol, and more specifically Nitinol having a material activation temperature, $A_f$, above 20 degrees C., or more specifically, between 20 degrees C. and 40 degrees C., or more specifically, between 25 degrees C. and 37 degrees C. The supports are constructed using their shape memory properties so that in their activated state they assume an expanded configuration. Thus, to install the device the user first compresses the supports 20, and they remain in a compressed, undeployed state because the supports are below their $A_f$ temperature. However, when the user places the device in the ear canal the supports warm to above the $A_f$ temperature and then resume their expanded or deployed configuration to lodge in the canal.

The membrane 30 is a flexible sheet which is roughly spherical in shape. The proximal end of membrane 30 is anchored to the body 10 by proximal connector 24 and the distal end of membrane 30 is anchored to the body 10 by distal connector 22. The membrane is shaped so that its inner surface contacts the supports. The purpose of the membrane 30 is to provide a surface suitable for contacting the ear canal wall. Conformability to irregular shapes of ear canals is important but not necessary. For example, an elastic material like silicone or polyurethane can be used, but also a strong, thin film material that is capable of folding over itself like Saran Wrap film may also be used, provided the membrane can conform to varying ear canal cross sections without creating excessive air gaps. Membrane thicknesses may range from 0.00025 to 0.2 inches thick depending on location and type of material, and more particularly between 0.005 to 0.050 inches thick and even more particularly from 0.001 to 0.025 inches thick. For example, a soft elastic silicone membrane can be made with 0.05 inch thick proximal and distal ends tapering to a 0.007 inch thick middle section. The thicker ends provide more robust mounting points while the thinner middle section allows for increased compliance and wall contact. In other words, in one embodiment the membrane comprises at least two zones, and the membrane has a first thickness in the first zone and a second thickness in the second zone. The first thickness should be between about 0.00025 and 0.02 inches, and the second thickness should be between about 0.02 and 0.2 inches. Silicone membranes typically have a hardness ranging from 5 Shore A to 90 Shore A. Other materials that may be used include latex, any elastic polymer, thin film polymers (PET, nylon or others) or other elastomers. In some circumstances inelastic materials can be used.

In operation, a user compresses the supports 20 and the membrane 30 to install the in-the-canal hearing device 8 in the user's ear canal 32. Once the device 8 is located in the appropriate position the supports 20 and the membrane 30 expand to seal the device to the user's ear canal. It should be understood that independent movement of the supports 20 relative to one another allow the supports 20 to expand and compress to different positions. Hence, ear canals with varying cross-sectional shapes can be accommodated. Also, in one embodiment the membrane 30 is coupled to the supports 20, while in alternative embodiments the membrane 30 is not coupled to the supports 20.

In the embodiment shown in FIGS. 1-3, the distal and proximal connectors 22 and 24 are fixed in position with respect to the body 10. Alternatively, however, the connectors 22 and 24 can be constructed to slide along the body 10 to allow the supports to retract as they are collapsed during insertion into the ear. Either the distal connector 24 or the proximal connector 22 can be fixed while the other connector can slide, or alternatively, both connectors can slide.

The supports 20 are preferably made of a superelastic material, a binary Nickel-Titanium alloy sometimes called Nitinol. Alternatively, they can be made of other superelastic materials or in some cases spring metal or other elastic materials. The selection of the material for the supports 20 is important. Nitinol is preferred because of the stress-strain characteristics of the material. The stress-strain curve of Nitinol includes a relatively horizontal zone which is known as the "loading plateau". It is in this region that additional strain (in the case of the hearing aid in the ear canal, that additional strain is equivalent to placement in smaller ear canals) results in almost no increase in outward reactive force. Dimensions of the supports 20 should be chosen so as to create a bending stress within them characterized by the loading plateau of the chosen superelastic material. For superelastic Nitinol, with an austenitic transition temperature of approximately −15 to 20 degrees Celsius, this will be a member between 0.002 and 0.02 inches in diameter. This will produce a peak stress within the frame members of approximately 50,000 psi or more, at which point the material's superelastic behaviors are exhibited. In contrast, in prior in-the-canal devices which incorporate materials such as foams, the outward reactive force caused by the springiness of the foams, elastomers, gels, etc., can cause patient discomfort, particularly after extended use.

Figure 4:
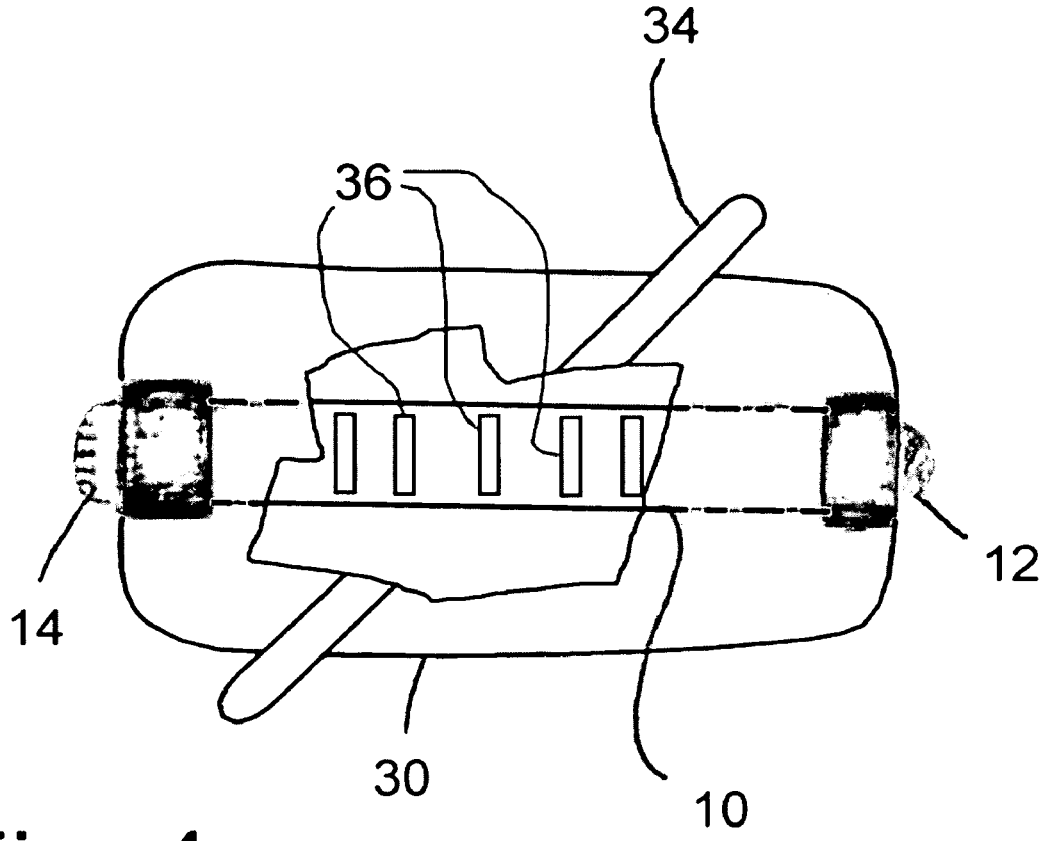
FIG. 4 is a partially cut away view of another embodiment of a self-expanding hearing device according to the present invention.
Figure 5:
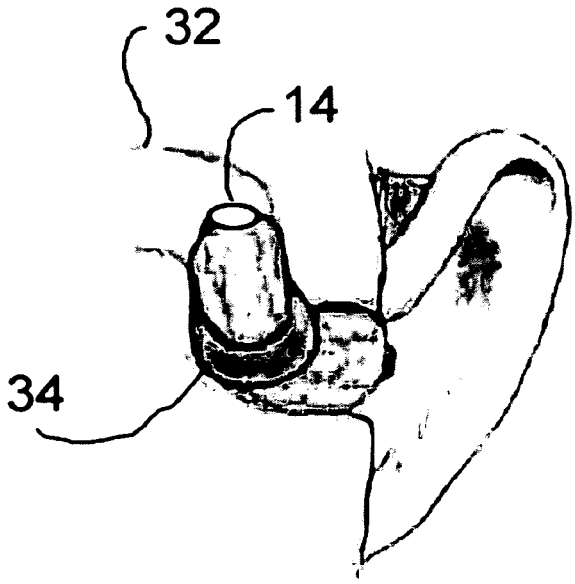
FIG. 5 is a view of the embodiment of FIG. 4 installed in the ear canal.

Turning to FIGS. 4-5, an alternative embodiment of the in-the-canal hearing device is shown. This embodiment includes a sealing fin 34 affixed to the membrane 30. The sealing fin may be molded with the membrane or bonded on top of the membrane. The purpose of the sealing fin is to provide an increased size adjustment capability and improved acoustic seal in the ear. The thickness of the sealing fin can vary from less than 0.0005 to 0.04 inches. Also, in this embodiment a plurality of slits 36 are formed in the body 10 to allow the body to be more flexible.

Figure 6:
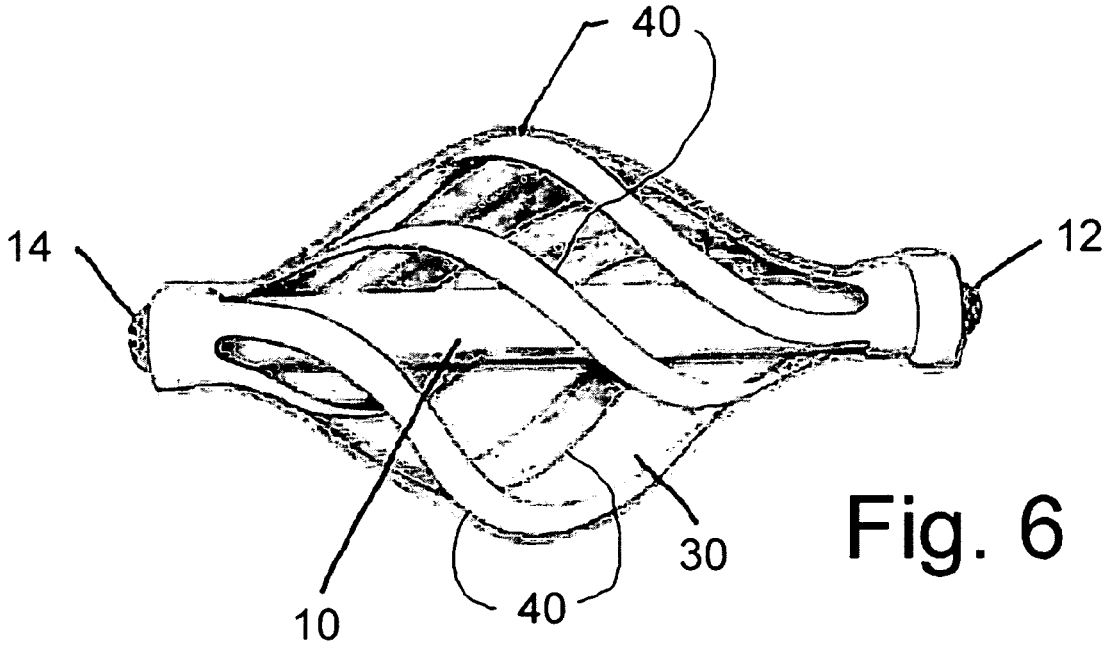
FIG. 6 is a partially cut away view of another embodiment of a self-expanding hearing device according to the present invention.
Figure 7:
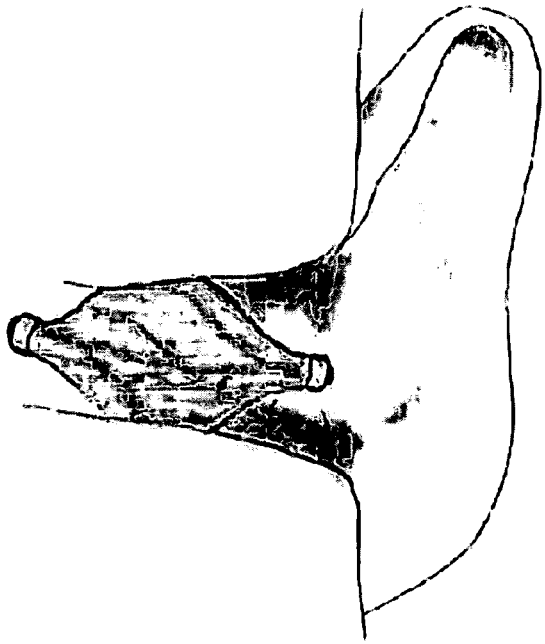
FIG. 7 is a view of the embodiment of FIG. 6 installed in the ear canal.

FIGS. 6-7 illustrate another embodiment in which the frame comprises an expandable "basket." The "basket" includes spiral supports 40 which are ribbon shaped. This embodiment utilizes a spiral formed expandable basket used to conform to the contours of the ear canal. Similarly to the embodiments shown in FIGS. 1-5, the spiral shaped supports are compressed for insertion into the ear and rebound back to an expanded position in the ear. A membrane 30 is used to provide a smooth surface to contact the ear wall. Either end of the spiral shaped supports 40 can be allowed to "float" or slide on the body 10 to allow the supports to be compressed. Alternatively, the supports 40 may be twisted for compression from an expanded position.

Figure 8:
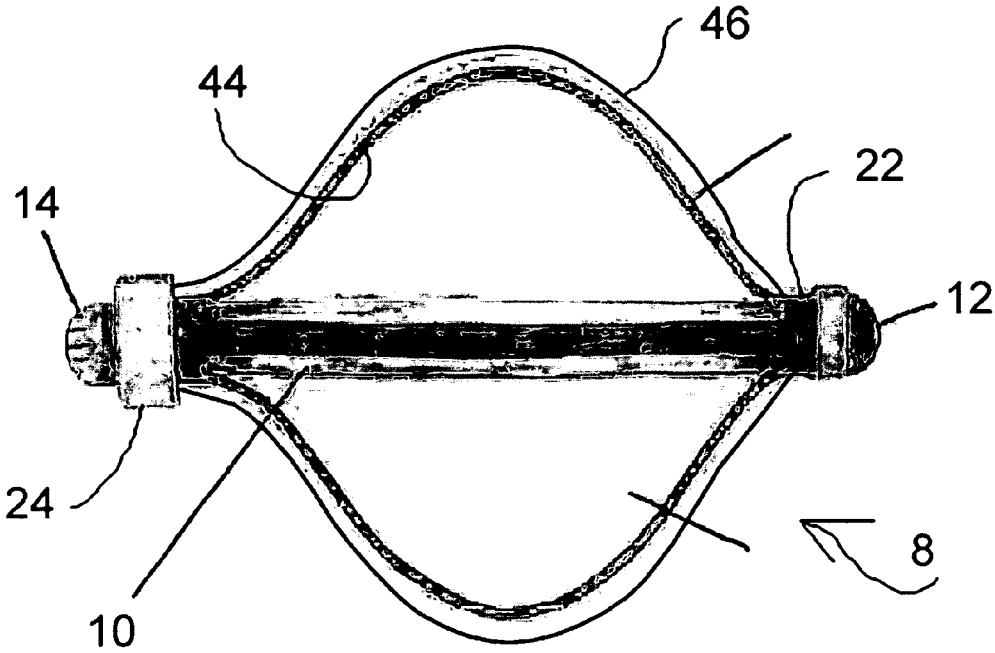
FIG. 8 is a partially cut away view of another embodiment of a self-expanding hearing device according to the present invention.
Figure 9:
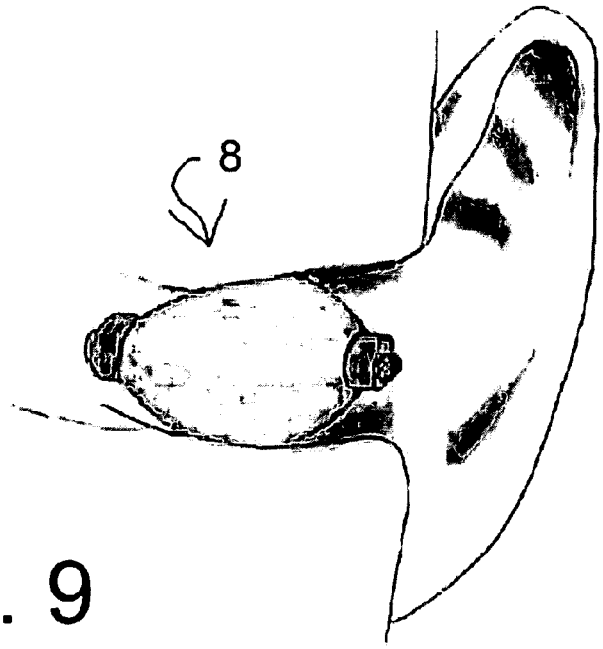
FIG. 9 is a view of the embodiment of FIG. 8 installed in the ear canal.

The embodiment shown in FIGS. 8-9 utilizes the same three basic design components as the previous embodiments, namely a body, a membrane, and a frame. This embodiment includes a plurality of straight supports 44. At the proximal end of the device, near the speaker 14, the supports 44 are connected to the distal end of the proximal connector 24 so that as the supports 44 leave the connector 24 they extend in the distal direction. At the distal end of the device, near the microphone 12, the supports 44 are connected to the proximal end of the distal connector 24 so that as the supports 44 leave the connector 24 they extend proximally.

Figure 10:
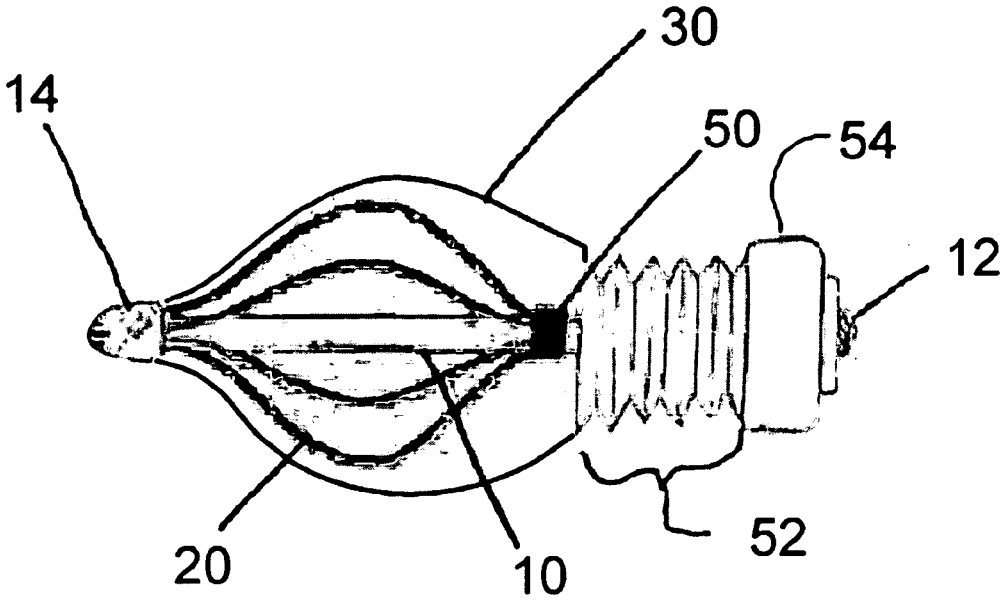
FIG. 10 is a partially cut away view of another embodiment of a self-expanding hearing device according to the present invention.

Another embodiment is illustrated in FIG. 10. This embodiment comprises a sliding distal connector 50 which can slide along the body 10, and further comprises a bellows 52 connecting the proximal end of the membrane 30 to a distal mount 54. In this embodiment the supports 20 can easily collapse as the device is inserted into the ear canal. Thus, the force required to "stretch" the membrane 30 is reduced.

Figure 11:
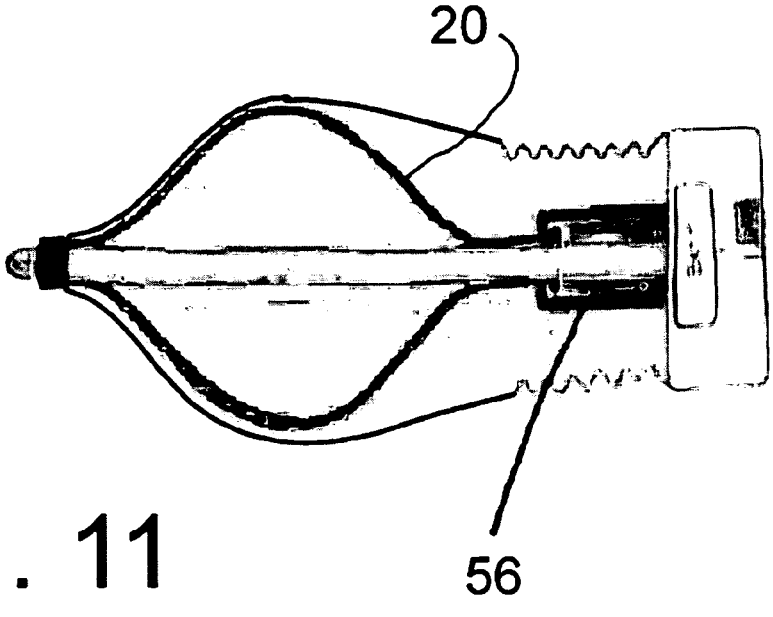
FIG. 11 is a partially cut away view of another embodiment of a self-expanding hearing device according to the present invention.

Another embodiment is illustrated in FIG. 11, which shows a stationary housing 56 that provides space for the ends of supports 20 to move more independently from one another. This feature provides greater adjustability to varying cross-sectional shapes of the ear canal.

Figure 12:
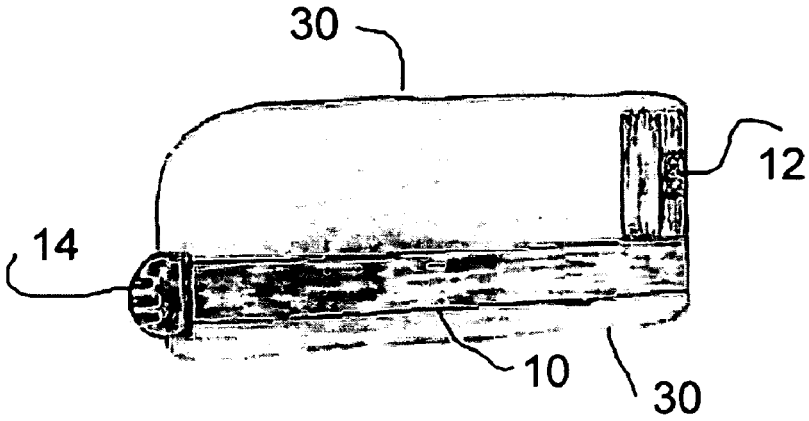
FIG. 12 is a partially cut away view of another embodiment of a self-expanding hearing device according to the present invention.
Figure 13:
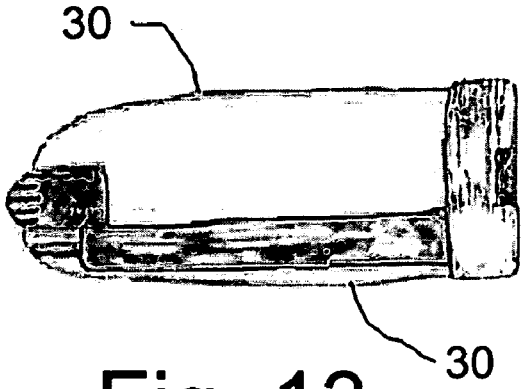
FIG. 13 is a partially cut away view of another embodiment of a self-expanding hearing device according to the present invention.

FIGS. 12-13 show alternative embodiments which include asymmetric construction where the body 10 is biased to one side of the device. These embodiments show that the membrane 30 and supports 20 do not necessarily center around the body 10.

Figure 14:
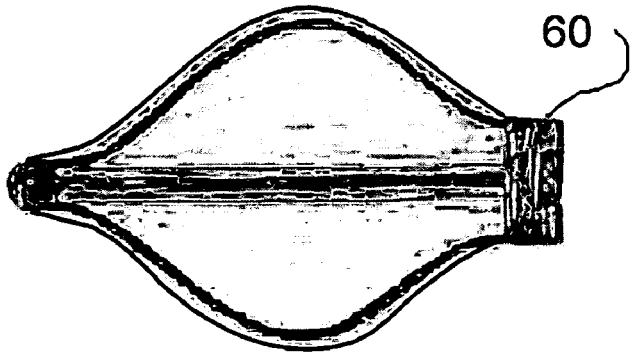
FIG. 14 is a partially cut away view of another embodiment of a self-expanding hearing device according to the present invention.

FIG. 14 shows an embodiment where the distal connector 22 has been integrated with microphone 12 and a battery housing 60.

FIGS. 15-21 show a scaffold structure 64 shaped in a mesh configuration in place of supports 20. In this embodiment, the scaffold structure 64 floats independently of the body. Typically, the scaffold structure 64 is in an expanded position and is compressed to facilitate insertion into the ear. Scaffold structures can be made from metals (like Nitinol—super-elastic/shape memory) or plastics and composites. Elgiloy is another alternative.

Figure 15:
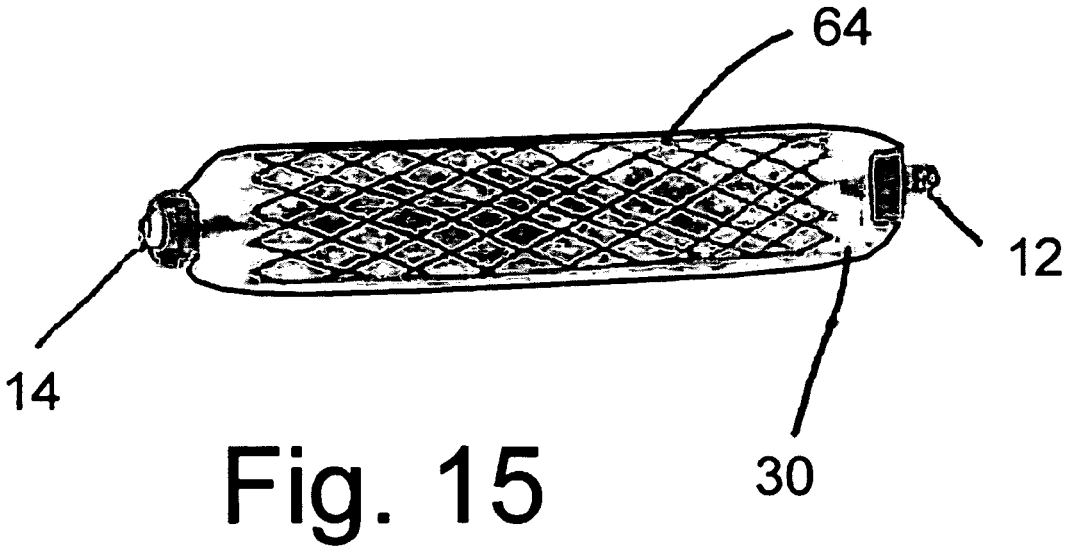
FIG. 15 is a partially cut away view of another embodiment of a self-expanding hearing device according to the present invention.
Figure 16:
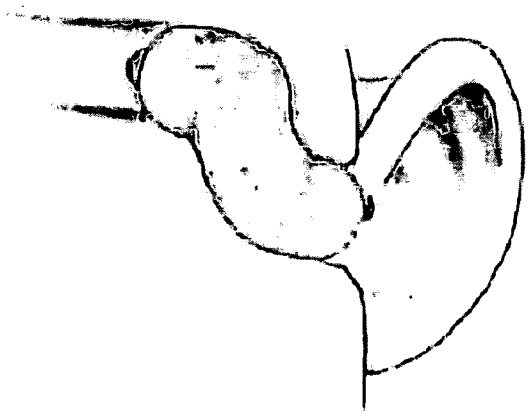
FIG. 16 is a view of the embodiment of FIG. 15 installed in the ear canal.
Figure 17:
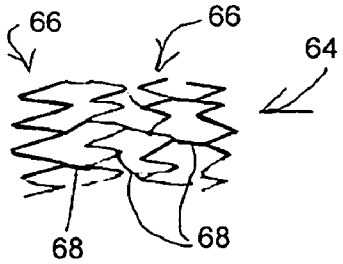
FIG. 17 is a detail of an alternative embodiment of one component of the device of FIG. 15.
Figure 18:
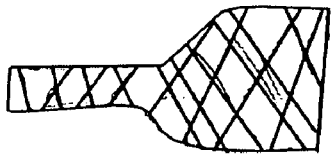
FIG. 18 is a detail of an alternative embodiment of one component of the device of FIG. 15.
Figure 19:
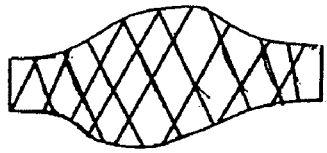
FIG. 19 is a detail of an alternative embodiment of one component of the device of FIG. 15.
Figure 20:
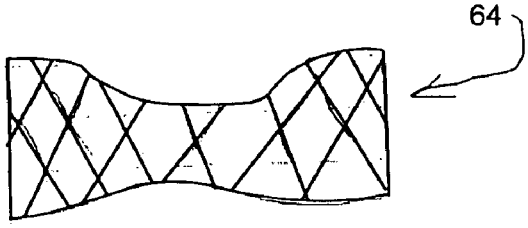
FIG. 20 is a detail of an alternative embodiment of one component of the device of FIG. 15.

FIG. 15 shows a braided scaffold design. Other alternative designs may include a linked cell structure as shown in FIG. 17 wherein cells 66 are interconnected by links 68. As an alternative, the scaffold structure 64 may be asymmetrical. It may be desirable to have varying compliance (stiffness/opening force) in different sections of the scaffold. For example, the end section(s) may need to be softer to allow easier tapering during introduction and removal.

Figure 21:
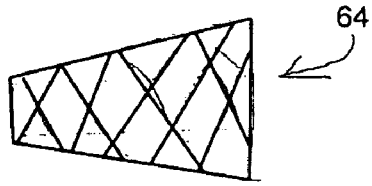
FIG. 21 is a detail of an alternative embodiment of one component of the device of FIG. 15.

The scaffold structure 64, which may also be called a frame, may also be formed in a profiled shape to improve wall contact, and the frame can be comprised of a plurality of sections. For example, in each of FIGS. 18-21 there is a proximal, a middle and a distal section. These designs include: expanded middle (FIG. 19), barbell (FIG. 20), stepped end (FIG. 18), and cone (FIG. 21).

Figure 22:
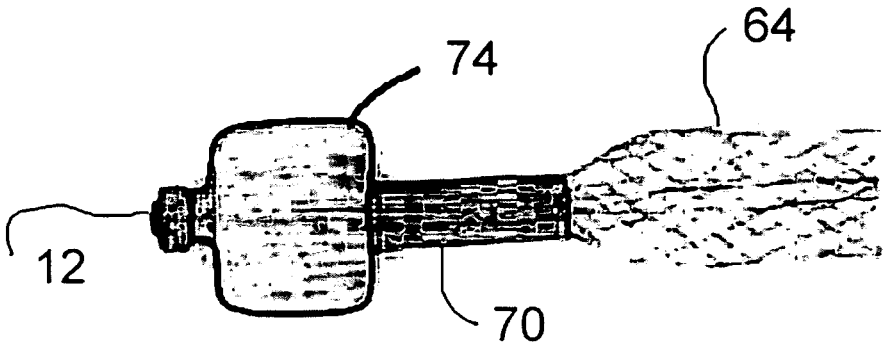
FIG. 22 is a partially cut away view of another embodiment of a self-expanding hearing device according to the present invention.
Figure 23:
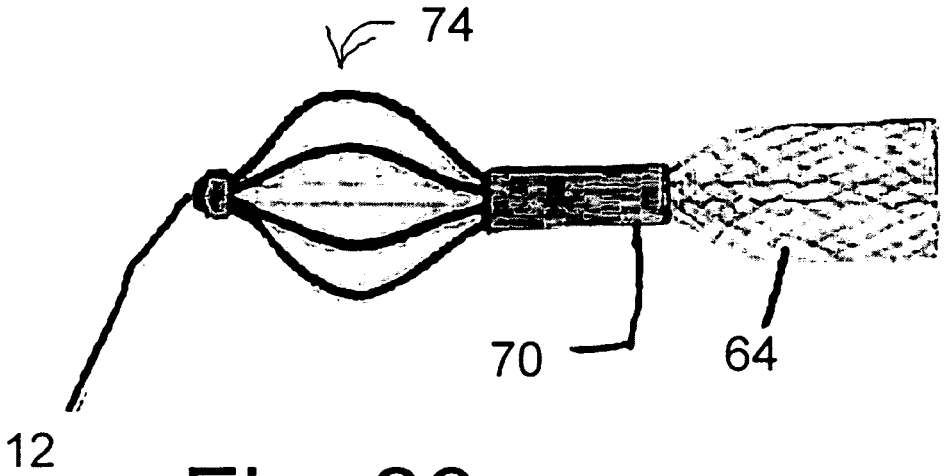
FIG. 23 is a partially cut away view of another embodiment of a self-expanding hearing device according to the present invention.
Figure 24:
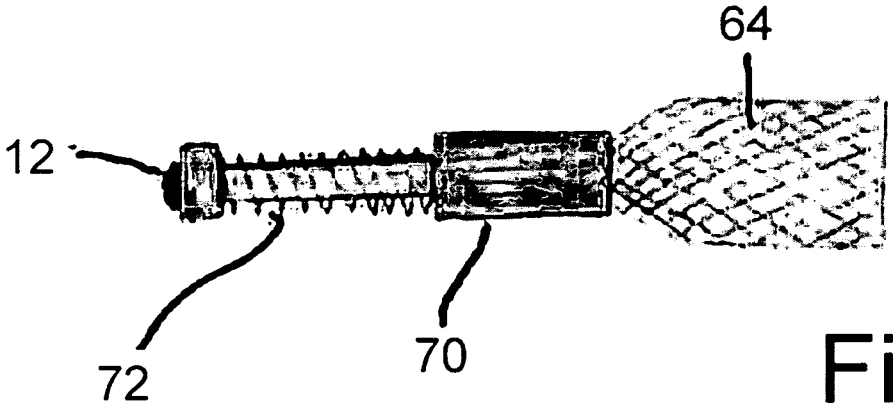
FIG. 24 is a partially cut away view of another embodiment of a self-expanding hearing device according to the present invention.

FIGS. 22-24 show scaffold designs with integrated deployment sheaths. These embodiments use a sliding sheath 70 to help capture the scaffold structure 64 for easy insertion into the ear. In each of these embodiments, the sliding sheath 70 is connected to a spring 72 or expanding member 74. For these designs, a user would hold or compress the expanding member 74 causing the sheath 70 to cover scaffold 64 thereby making the device easier to insert. Once in place, the user releases the spring 72 or expanding member 74 which pulls back on the sheath 70. In FIGS. 22 and 23, the retraction of the sheath allows the expanding member to deploy thereby creating a second sealing area. For FIG. 22, the expanding member 74 may be an elastic balloon and/or foam-filled body.

Figure 25:
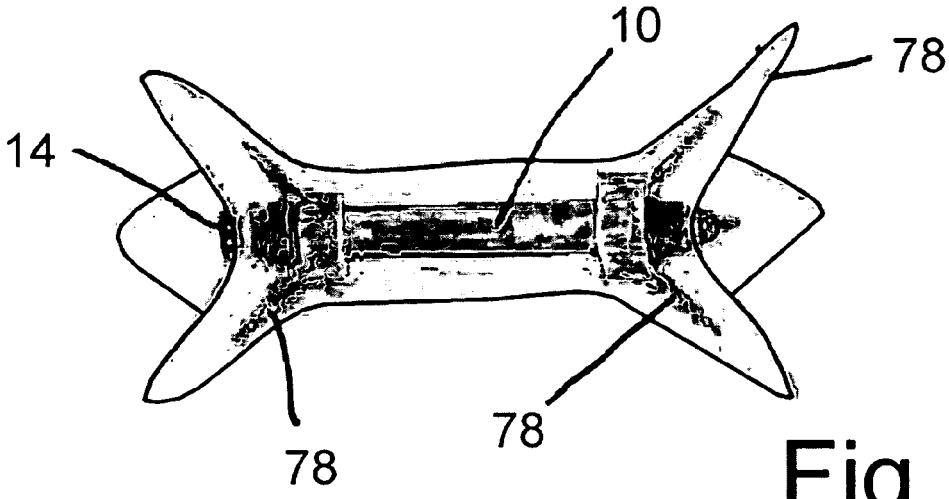
FIG. 25 is a partially cut away view of another embodiment of a self-expanding hearing device according to the present invention.
Figure 26:
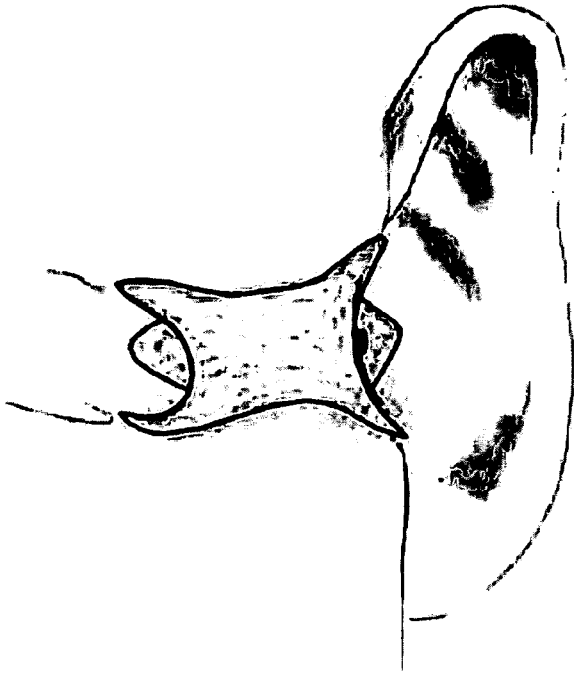
FIG. 26 is a view of the embodiment of FIG. 25 installed in the ear canal.

The embodiment of FIGS. 25-26 utilizes prongs 78 on both ends of the device to create a seal and secure the device in the ear canal. The prongs 78 are compressed during insertion into the ear and allowed to flair or spring out to create conforming seal.

Figure 27:
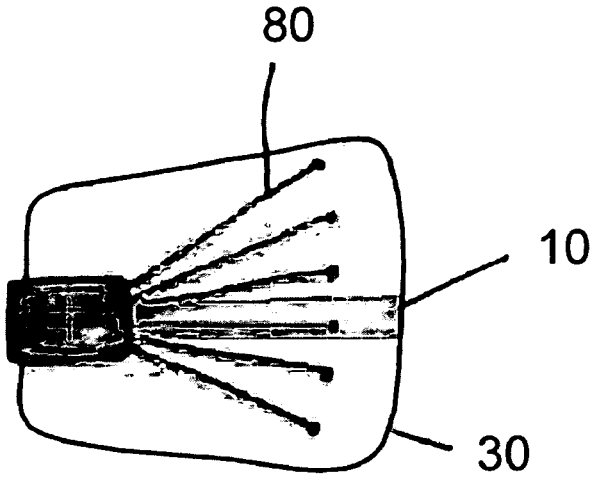
FIG. 27 is a partially cut away view of another embodiment of a self-expanding hearing device according to the present invention.
Figure 28:
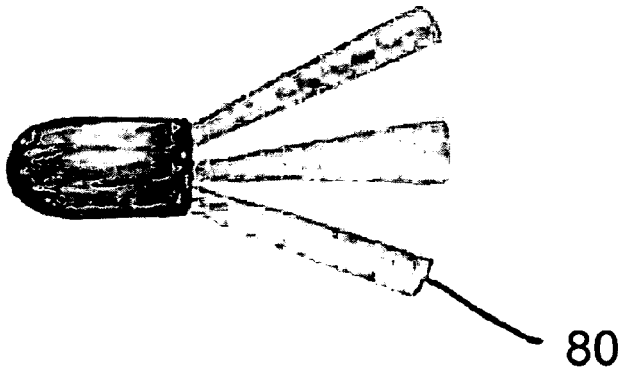
FIG. 28 is a partially cut away view of another embodiment of a self-expanding hearing device according to the present invention.
Figure 29:
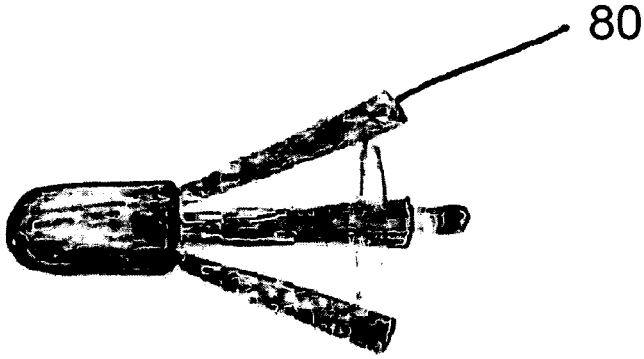
FIG. 29 is a partially cut away view of another embodiment of a self-expanding hearing device according to the present invention.

FIGS. 27-29 illustrate a single-sided flaring prong design. These illustrations show flaring prongs 80 only to one side of the device. The flaring prongs 80 can be collapsed by either compressing the expanded end of flair prongs or pinching the base where the flaring prongs join or meet. This configuration could be designed to work with either end inserted proximal (closer to the inner ear).

Figure 30:
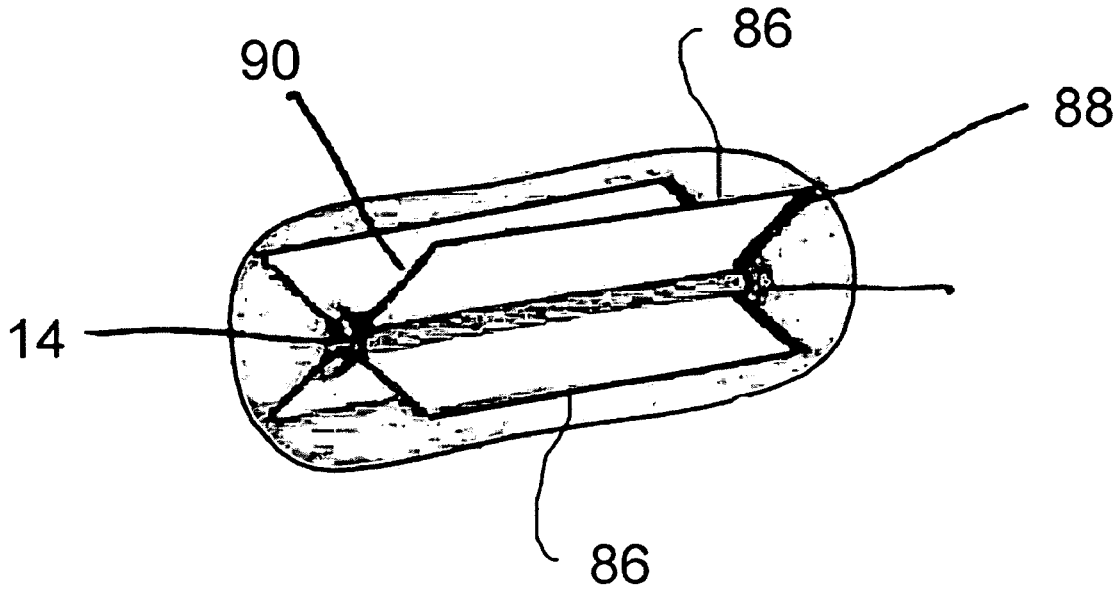
FIG. 30 is a partially cut away view of another embodiment of a self-expanding hearing device according to the present invention.

The embodiment illustrated in FIG. 30 utilizes expanding spars on the proximal and distal ends (or adjacent to the ends) of the body 10. This configuration has connecting members 86 running between the distal to proximal spars. The distal spars 88 are designed to be stiffer than the proximal spars 90. Therefore, when the distal spars 88 are collapsed for insertion into the ear, the proximal spars 90 also collapse.

Figure 31:
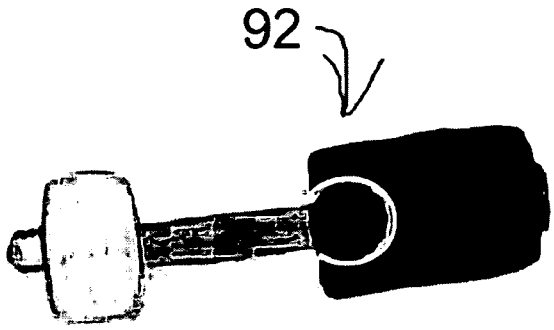
FIG. 31 is a partially cut away view of another embodiment of a self-expanding hearing device according to the present invention.

The embodiment shown in FIG. 31 shows the use of mechanical pivot point with a ball and socket joint 92 that provides easy shaping of the ear plug to fit contours of each individual ear canal shape.

FIG. 32 shows another embodiment of a hearing device that would facilitate insertion. As the hearing device is pushed into the ear canal, the force causes an expandable seal 100 to elongate and reduce in diameter. Once pressure is removed from the body 10, the expandable seal 100 rebounds to a larger diameter creating a seal in the ear. The expandable seal 100 may be constructed with or without a supports or may just a simple formed bulbous skin/member.

FIG. 33 illustrates a single-sided seal design where the sealing occurs at an expandable member 102 located on one end of the hearing device. The advantage of having a reduced sealing area is that this design requires less material and would be easier to compress and insert.

FIG. 34 follows the same idea as the embodiment of FIG. 33. It utilizes two smaller expandable seals 100 in conjunction with non-expanding seal 104 which can be thin sections on a conformable plastic.

Figure 35:
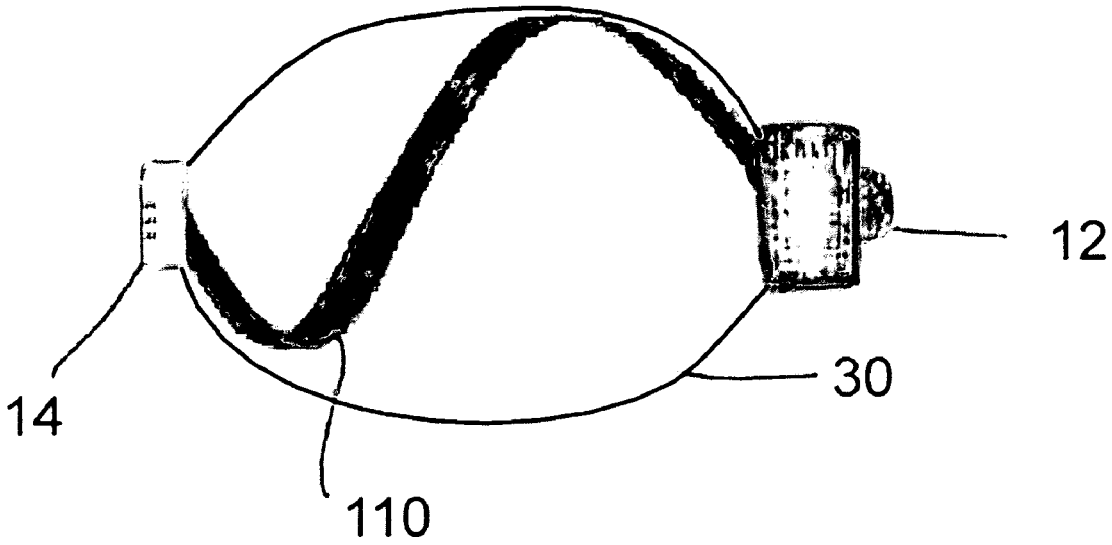
FIG. 35 is a partially cut away view of another embodiment of a self-expanding hearing device according to the present invention.

Another embodiment is shown in FIG. 35 which utilizes a spiral wound expansion member 110 to allow the hearing device to seal in the ear. By compressing and elongating or twisting the spiral expansion member, the diameter of the hearing device can be reduced for insertion. The absence of a core or body allows this design better compliance around bends in the ear. Although only one spiral expandable member 110 is shown in this illustration, multiple spiral members could be used and may even be counter-wound to provide different sealing characteristics. The microphone 12 can be electrically coupled to the speaker 14 by wires, not shown, running through the expansion member 110.

Figure 36:
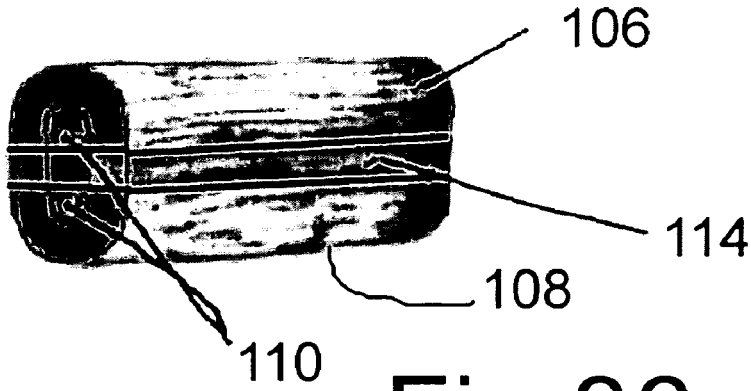
FIG. 36 is another embodiment of a self-expanding hearing device according to the present invention.

Another embodiment is shown in FIG. 36 which comprises of upper and lower hard outer shells 106 and 108, respectively, with an expandable member 110 between. The upper and lower hard outer shells 106 and 108 are attached to each other by an expandable joint 114. As an alternative, the hard outer shell may be layered by shingles, not shown.

Figure 37:
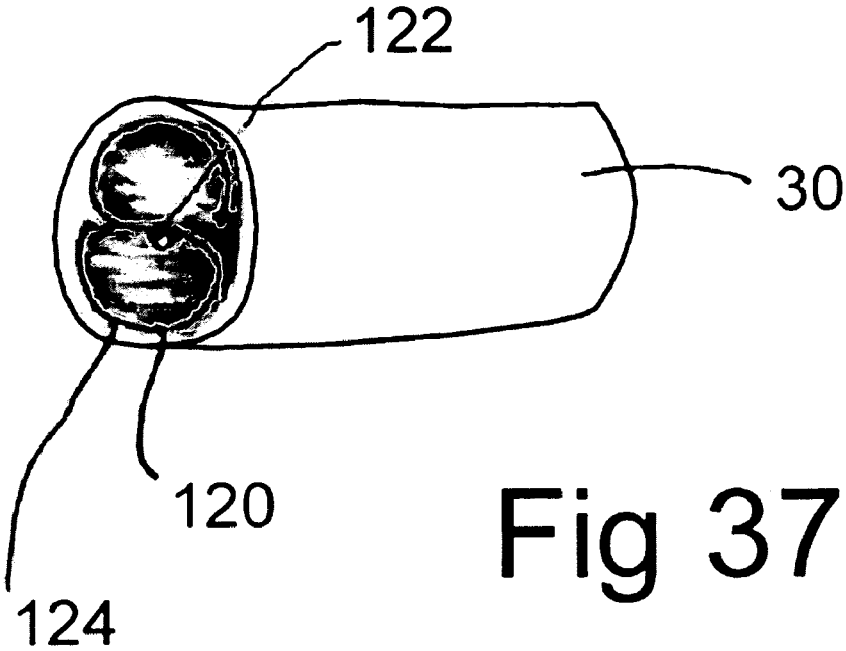
FIG. 37 is another embodiment of a self-expanding hearing device according to the present invention.

Another embodiment is shown in FIG. 37 which comprises an alternative expanding member or spring 120. The "S" design coils on itself around the center 122. The coil arms 124 can expand independently of one another, allowing the hearing device to expand in a non-symmetrical fashion. This design feature will allow an hearing device to fully open into a non circular cross-sectional ear canal.

Figure 38:
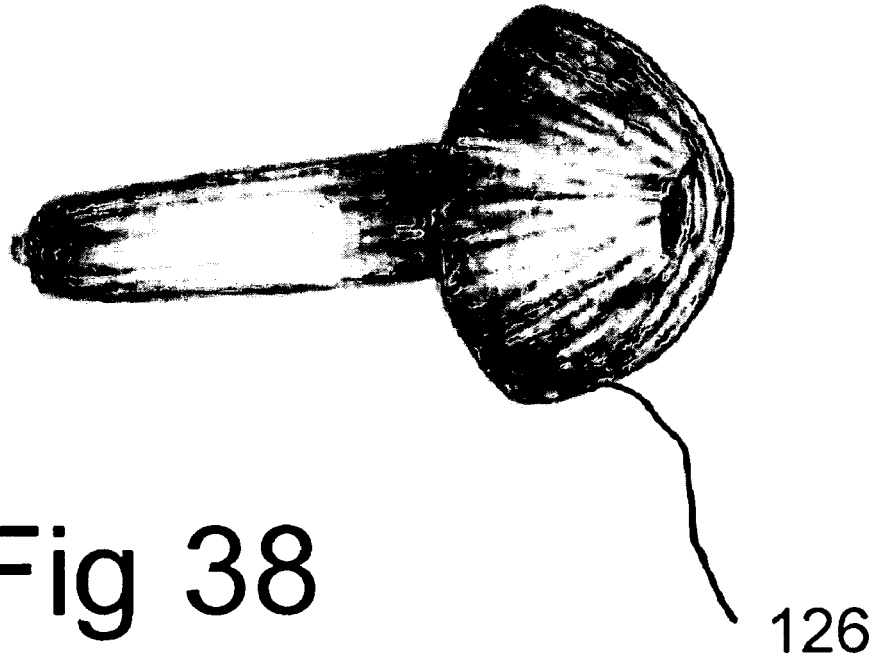
FIG. 38 is another embodiment of a self-expanding hearing device according to the present invention.

Another embodiment is shown in FIG. 38 which utilizes a flexible mushroom-shaped membrane 126 that may or may not require an additional expandable means to create a seal in the ear canal.

Figure 39:
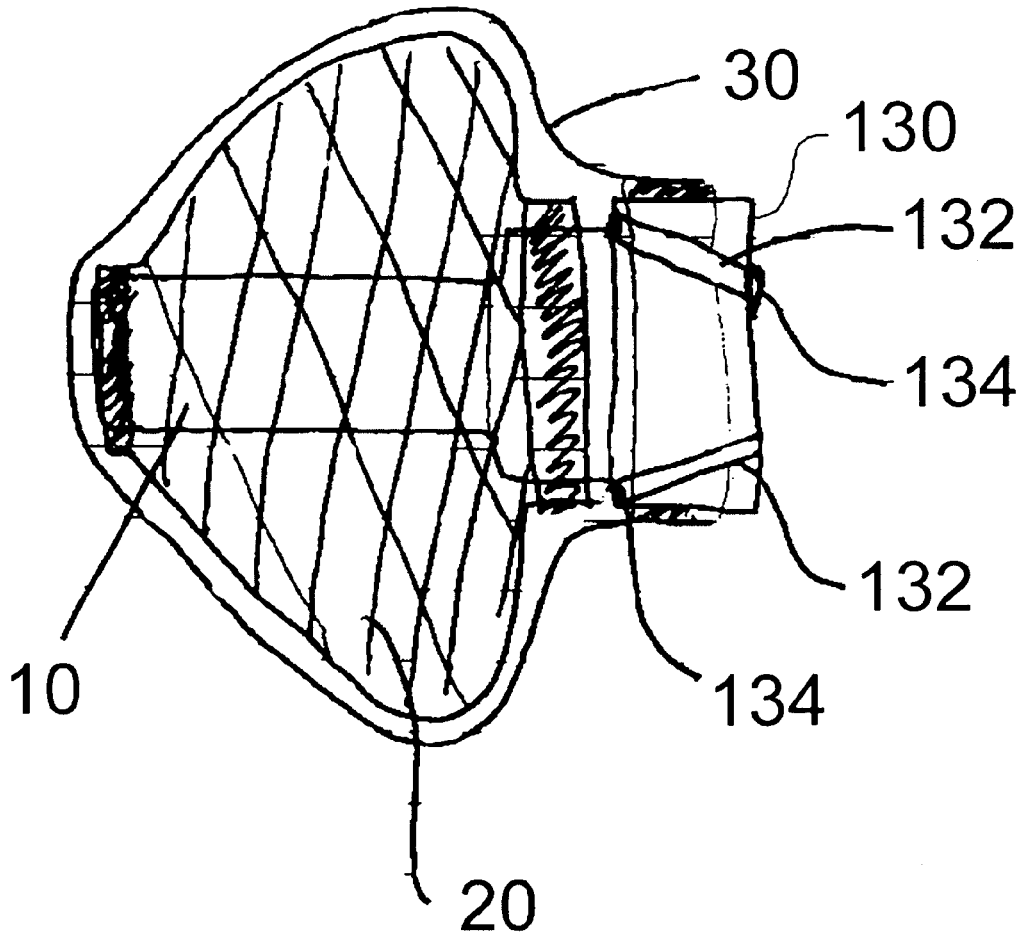
FIG. 39 is a partially cut away view of another embodiment of a self-expanding hearing device according to the present invention.
Figure 40:
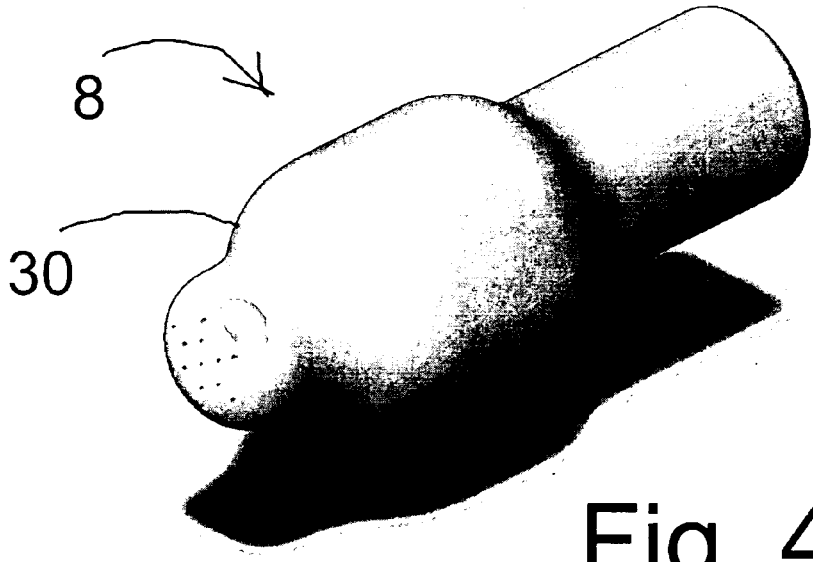
FIG. 40 is another embodiment of a self-expanding hearing device according to the present invention in an uncompressed, deployed position.

Turning now to FIG. 39, a self sizing hearing device with controlled expansion rate is shown. In some cases after the supports 20 and membrane 30 are compressed for insertion into the ear canal, it is important that the supports 20 and membrane 30 expand slowly before attaining a deployed, open state. This allows a user to insert a hearing device into one's ear canal at a slow pace without having to be concerned with introducing the device while compressing the structure.

Upon compression of the structure, air inside the membrane is expelled thereby creating vacuum under the membrane once the structure is released and allowed to expand. As air passes back under/through the membrane, the structure expands to a deployed state. By controlling the passage of air, the rate of expansion or deployment of the supports is controlled.

As shown in FIG. 39, the device includes a body 10, supports 20 and membrane 30. The membrane 30 is not permeable to air and at its distal end the membrane 30 is sealed to a distal support 130. Vent holes 132 are formed in the distal support 130 to allow easy passage of air out from under the membrane, but only allow a slower rate of air in. One or more vent hole(s) may be used, as well as different vent holes for exhausting and admitting air. Another alternative construction would be to use one way valves 134 to control air passage as shown on the next page. To further simplify the design, a single vent hole may be used in conjunction with the user's finger tip to control the passage of air into or under the membrane. As another alternative an air-permeable membrane can be used. This type of membrane may be used in conjunction with or independent of venting hole(s). Small pores in the membrane would allow air to pass though at a controlled rate thus controlling the expansion of the supports 20. As another alternative, an air-permeable membrane could be constructed by integrating valves into the membrane to allow controlled passage of air.

The concept of using the membrane and vacuum created when the structure and membrane are compressed may be used with the embodiments discussed above and shown in FIGS. 1-38.

Figure 41:
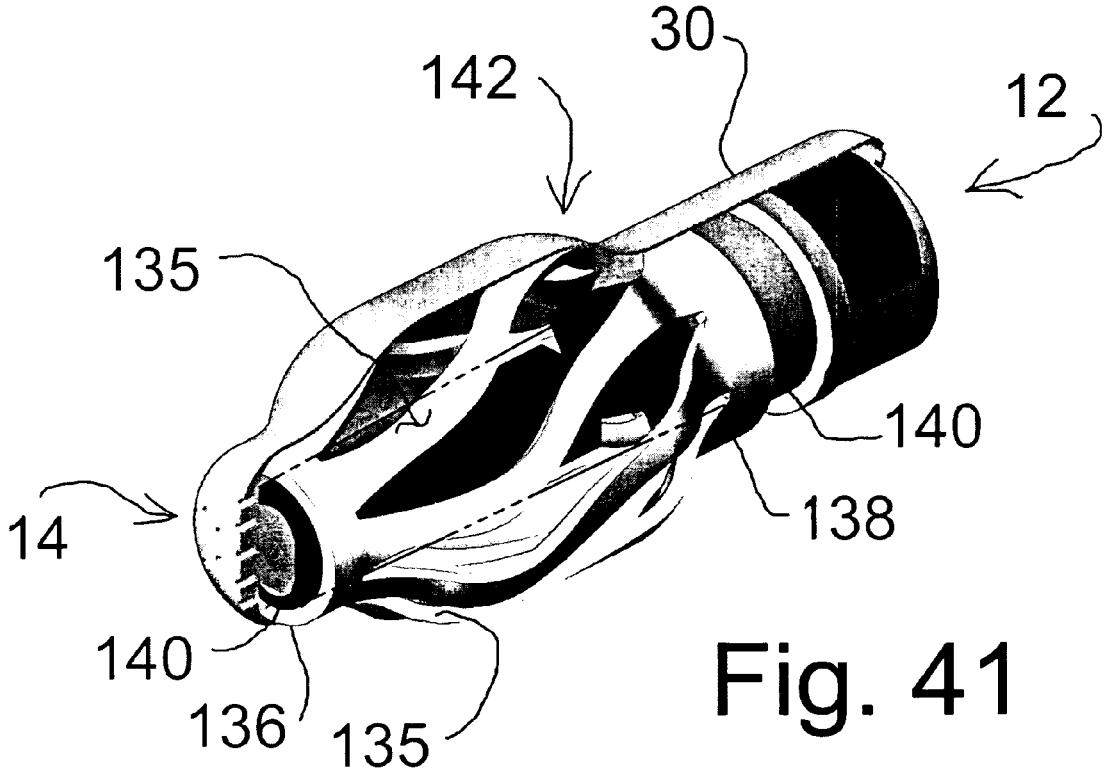
FIG. 41 is a partially cut away isometric view of the embodiment of FIG. 40.
Figure 42:
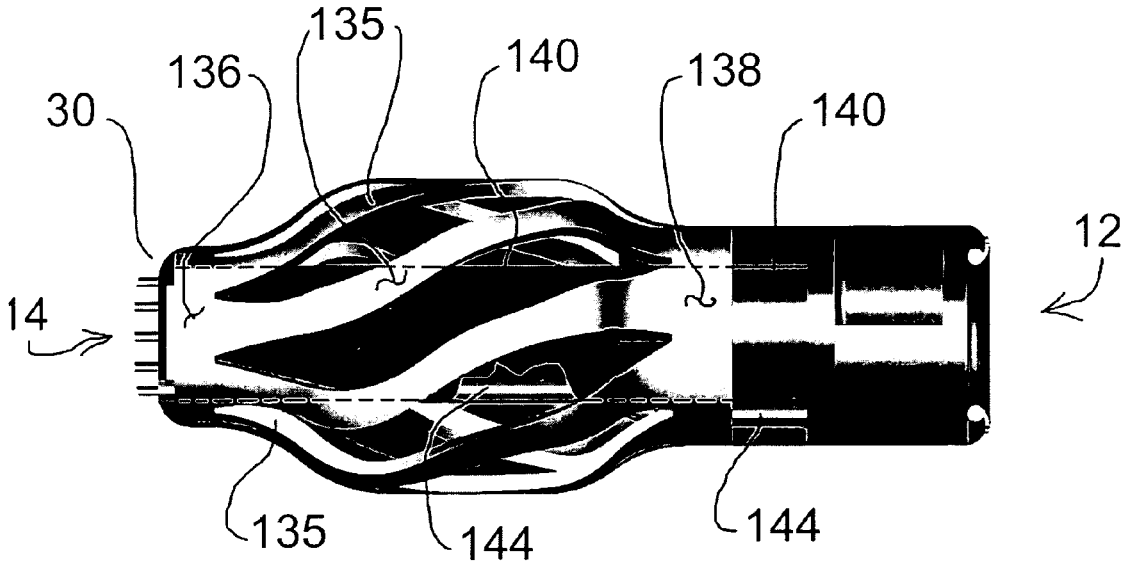
FIG. 42 is a partially cut away side view of the embodiment of FIG. 40.
Figure 43:
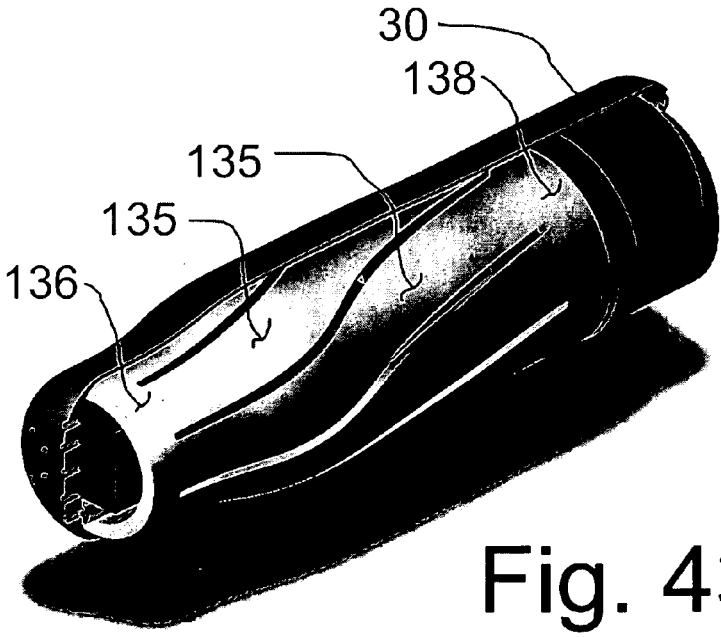
FIG. 43 is a partially cut away side view of the embodiment of FIG. 40 in a compressed, undeployed position.

Turning now to FIGS. 40-43 another alternative embodiment is shown in which the self-expanding hearing device 8 includes a membrane 146 which encloses the device. In FIG. 41 the membrane is partially cut away to show the interior of the device 8. In this embodiment the supports 135 are substantially flat and spiral shaped, and the supports 20 are connected at their proximal ends to a proximal ring 136 while at their distal ends the supports 135 are connected to a distal ring 138. The body 140 is substantially cylindrical and encloses electronic signal processing components 142, and the body 140 is partially cut away to show the electronic components 142. A pressure equalization tube 144 extends the length of the device to permit equalization of pressure when the device is inserted in the ear canal and the membrane seals against the ear canal. It should be understood that the supports 135 are flexible and resilient and are spaced apart from each other so that when the user compresses the supports 135 the proximal ring 136 rotates relative to the distal ring 138 and the spaces between the supports become smaller so that the supports 135 lengthen as shown in FIG. 43 as the distal ring 138 slides distally along the body 140. Thereafter when the user releases pressure the supports 135 reassume the shape shown in FIG. 42 thereby lodging in the ear canal. Alternatively, the device can be constructed so that when the user compresses the supports 135 the distal ring 138 rotates while the proximal ring 136 does not, and as another alternative, neither ring rotates.

Figure 44:
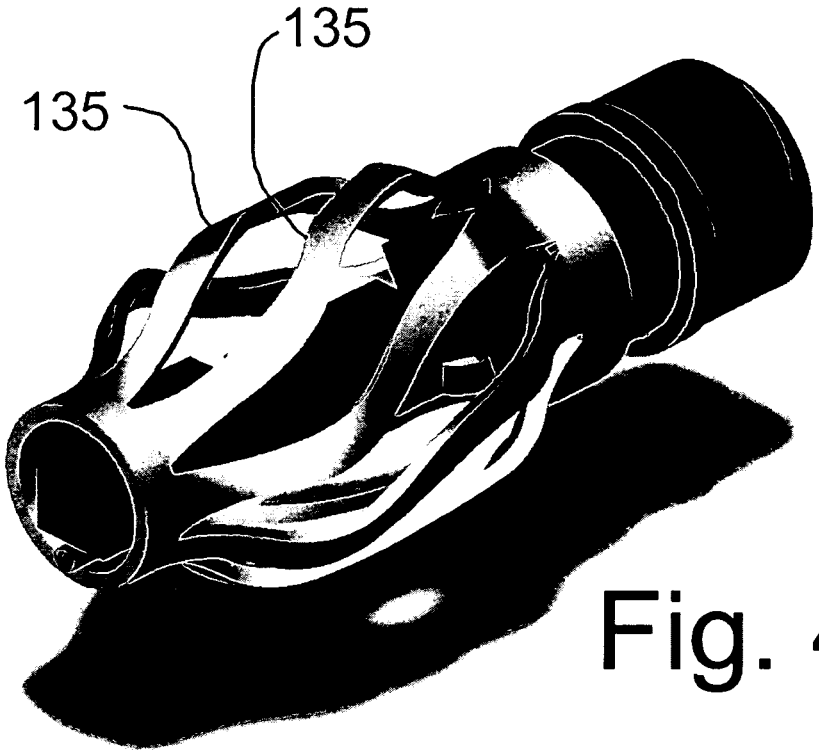
FIG. 44 is another embodiment of a self-expanding hearing device according to the present invention in an uncompressed, deployed position.

Turning now to FIG. 44 an alternative embodiment is shown. In this embodiment no membrane covers the supports 135. It should be understood that in many cases the membrane is required to provide an acoustic seal with the ear canal to reduce or eliminate acoustic feedback between the speaker 14 and the microphone 12. However, in some cases, when relatively little amplification is required or when feedback suppression can be obtained through enhanced signal processing algorithms, the membrane can be eliminated.

Figure 45:
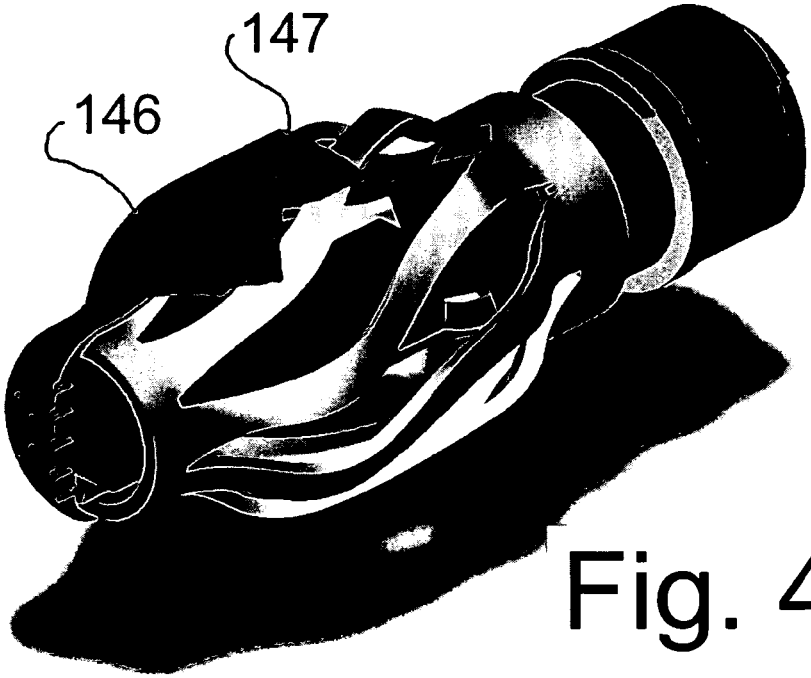
FIG. 45 is a partially cut away view of another embodiment of a self-expanding hearing device according to the present invention in an uncompressed, deployed position.

Turning to FIG. 45 an alternative embodiment is shown in which the membrane 146 covers only the proximal portion of the device, not the distal portion. The distal end 147 of the membrane 146 is located approximately at the middle of the device.

Figure 46:
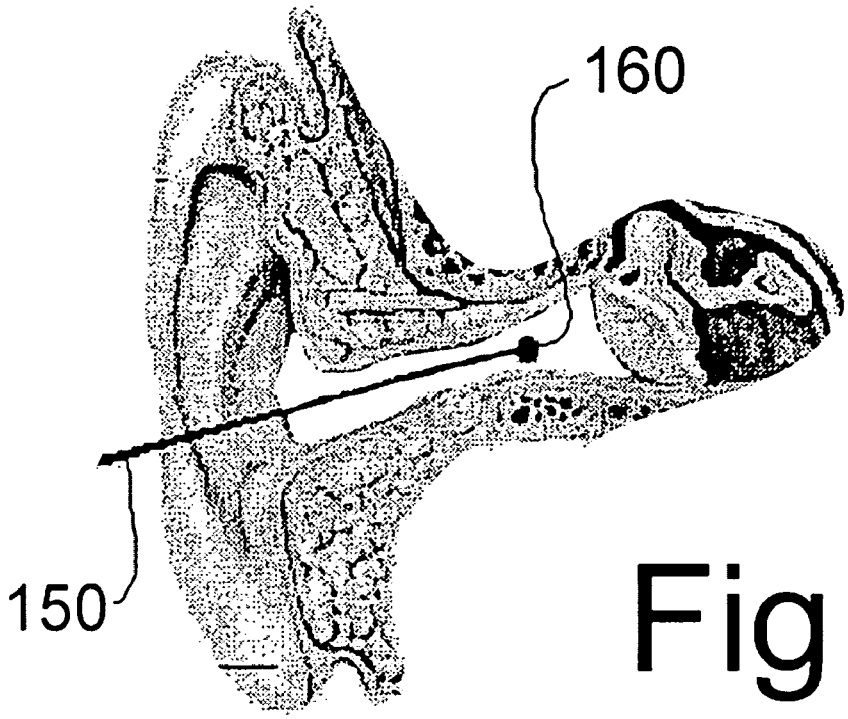
FIG. 46 is a side view of the frame of another embodiment of a self-expanding hearing device according to the present invention.
Figure 47:
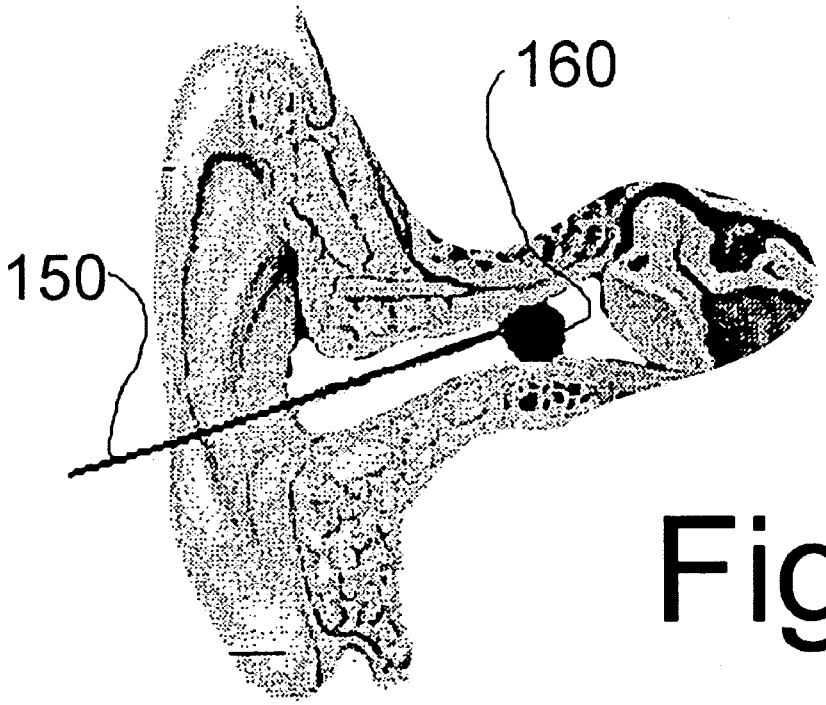
FIG. 47 is an isometric view of the frame of the embodiment shown in FIG. 46.
Figure 48:
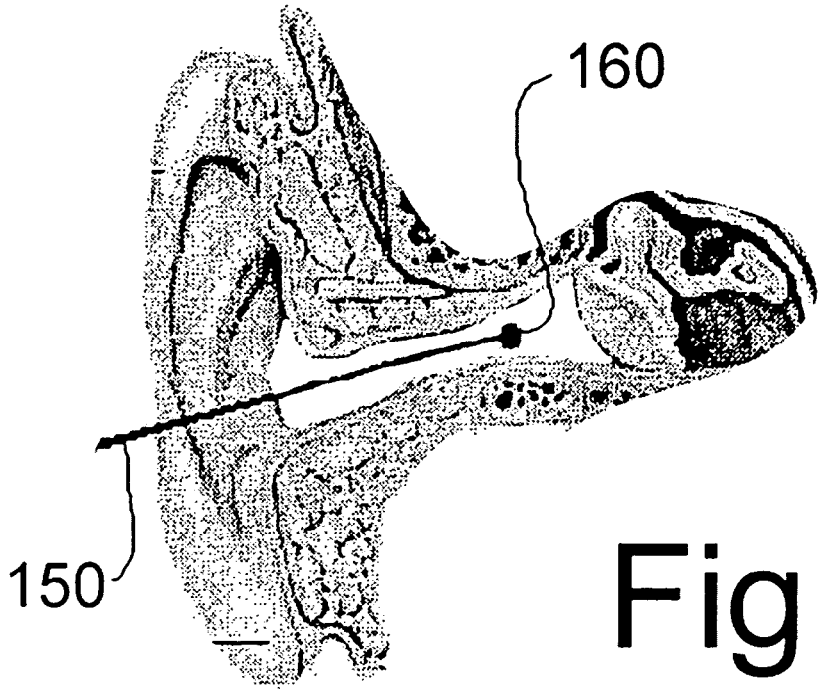
FIG. 48 is a view of one component of a balloon-expandable hearing device fitting system.
Figure 49:
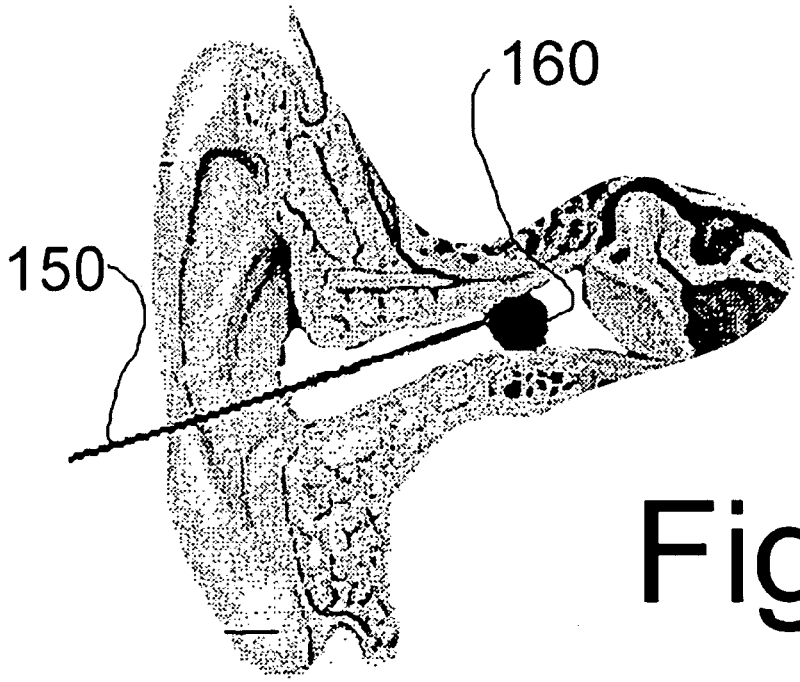
FIG. 49 is another view of a balloon-expandable hearing device fitting system.
Figure 50:
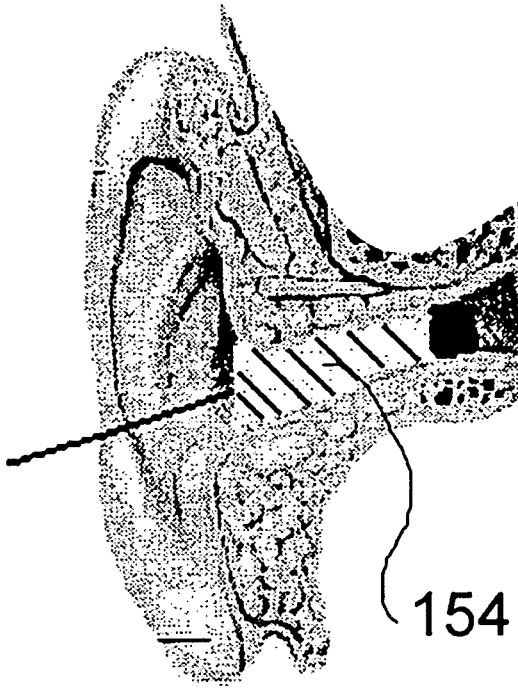
FIG. 50 is another view of a balloon-expandable hearing device fitting system.
Figure 51:
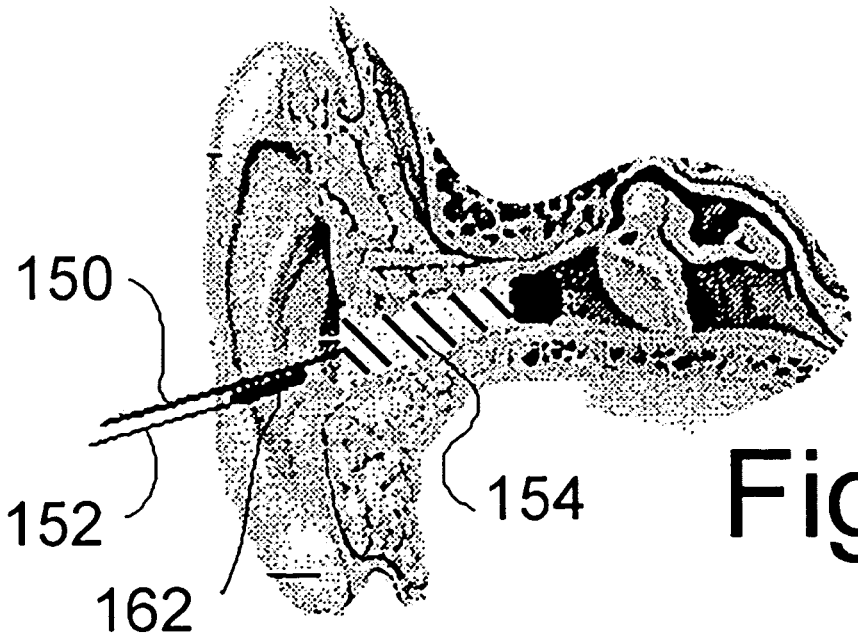
FIG. 51 is another view of a balloon-expandable hearing device fitting system.

With reference now to FIGS. 46-47, another alternative embodiment is shown. This embodiment comprises a proximal support structure 143 and a distal support structure 144. The proximal support structure 143 includes a proximal base 145 which is substantially cylindrical and is connected to a body, not shown, which is the same as the body 10 which is described above. Also, a membrane 30, not shown, covers the proximal and distal support structures 143 and 144. The proximal base 145 is connected to six arm members 146, which are in turn connected to a cylindrical support 147. The cylindrical support 147 is generally saw toothed in shape. The distal support structure 144 is substantially the same in configuration as the proximal support structure 143. The cylindrical support 147 of the proximal support structure 143 is connected to the cylindrical support 147 of the distal support structure 144 by six connector members 148. The proximal support structure 143 can be considered to be a proximal section of the device, while the distal support structure 144 can be considered a distal section of the device, and the connector members 148 can be considered to be a middle section of the device.

Turning now to FIGS. 48-57 a balloon-expandable rapid-fit hearing system is illustrated. The system consists of four main components, an occlusion wire 150, a balloon expander 152, ear gel 154 and a hearing aid 156. The system can be utilized for ITC and CIC—style hearing aids.

The occlusion wire 150 is a semi-rigid plastic or metal wire approximately three inches in length with a small (about 1 mm) lumen running the length of the wire through the center. At the distal end of the occlusion wire 150 is a soft-tip inflatable bulb 160. In the first step, illustrated in FIG. 48 the wire 150 is slightly bent to the curvature of the ear canal and then inserted into the ear approximately two-thirds the length of the ear canal. Using a syringe filled with saline solution, the hearing care professional (HCP) slowly inflates the soft tip bulb 160 to completely occlude the ear canal. The bulb takes the shape of the ear canal but can expand to a diameter of 12 mm. The patient feels pressure and "fullness" in the ear once the bulb is fully inflated. (Step 2, FIG. 49).

Next, in step 3, (FIG. 50) with the patient's head turned to the side, the HCP fills the ear canal with liquid ear gel 154 which is a curable material and may be silicone-based. The gel can be applied with a small bottle or syringe. The ear gel 154 then cures to semi-soft condition within 5-10 minutes. The ear gel may be cured by exposure to heat (body temperature), air or by mixture with a chemical catalyst.

Figure 52:
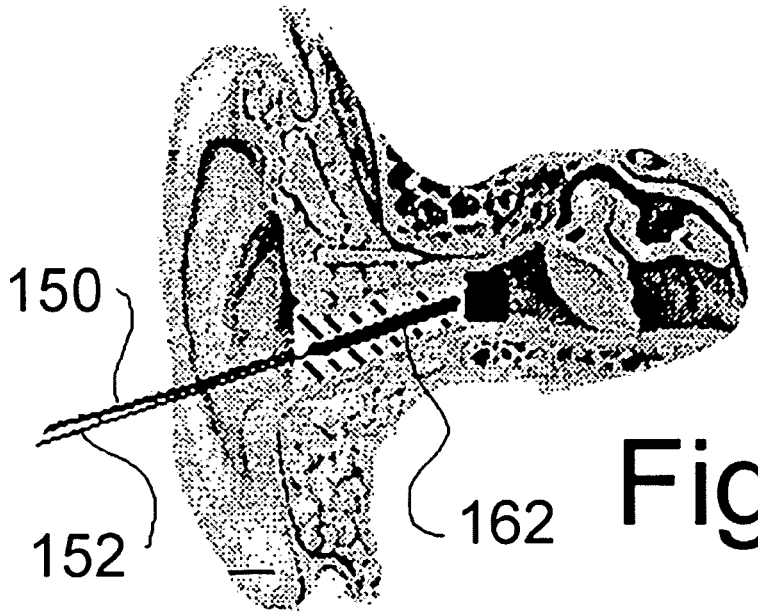
FIG. 52 is another view of a balloon-expandable hearing device fitting system.
Figure 53:
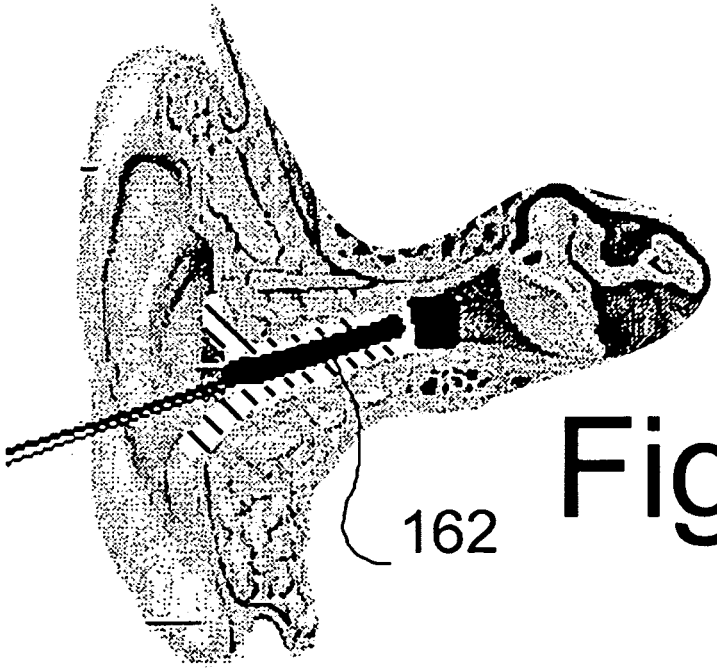
FIG. 53 is another view of a balloon-expandable hearing device fitting system.
Figure 54:
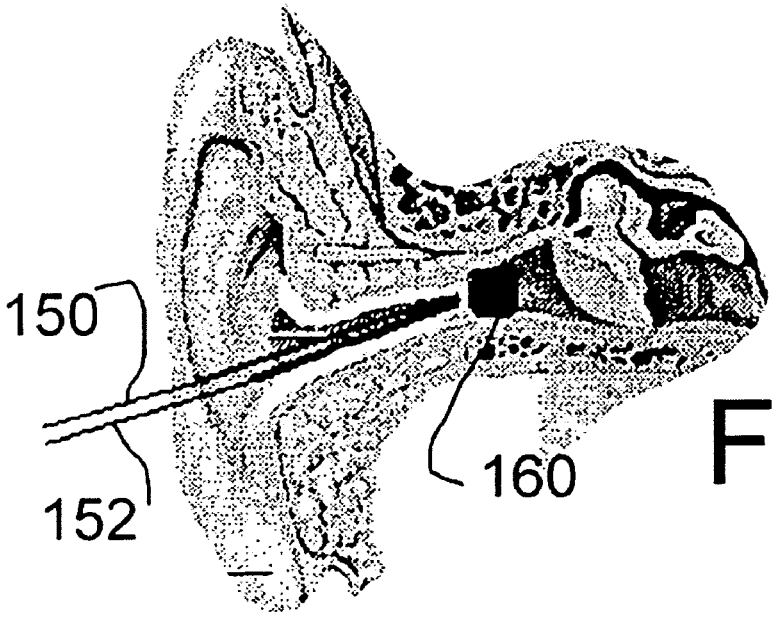
FIG. 54 is another view of a balloon-expandable hearing device fitting system.

Next, in Step 4 (FIG. 51) the balloon expander 152 is placed over the occlusion wire 150 and gently inserted within the ear gel 154 up to the soft tip bulb 160. The balloon expander 152 comprises a flexible metal or plastic-based wire with two lumens in the center of the wire, and a balloon 162 is mounted to the end of the expander 152. One lumen is used to track the balloon expander 152 over the occlusion wire 150, and the second lumen is used to inflate the balloon 162 once it is in the ear canal. In step 5, the balloon is then inflated using saline solution injected via a syringe, and the quantity of solution injected determines the degree of balloon inflation. (FIGS. 52-53). The expanded balloon 162 creates a "pocket" for the hearing aid. The balloon 162 is formed of a lubricious material so that it does not adhere to the ear gel 154. The balloon 162 is maintained in place as the ear gel cures.

Figure 55:
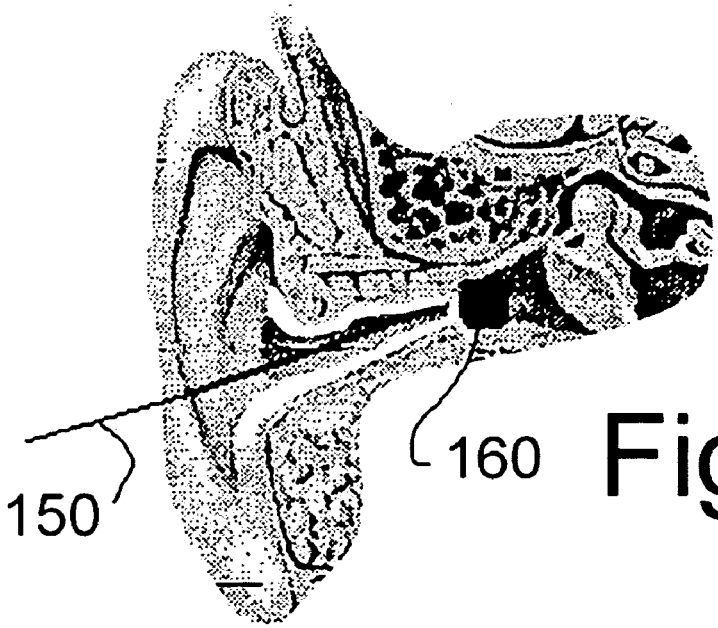
FIG. 55 is another view of a balloon-expandable hearing device fitting system.
Figure 56:
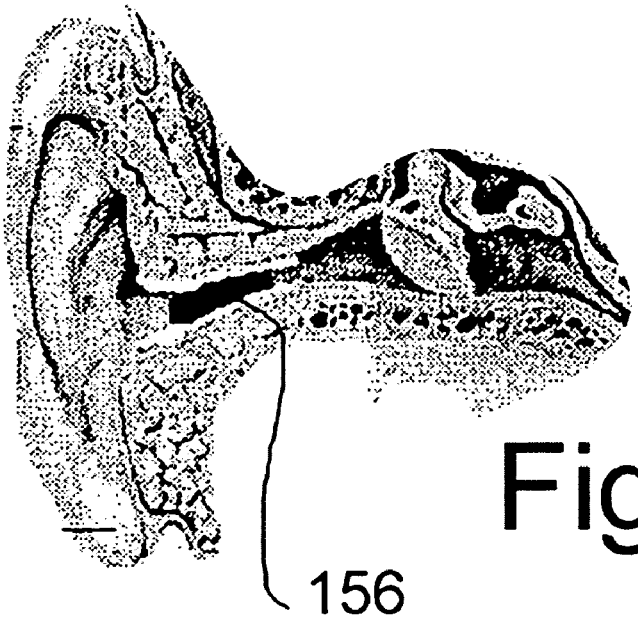
FIG. 56 is another view of a balloon-expandable hearing device fitting system.
Figure 57:
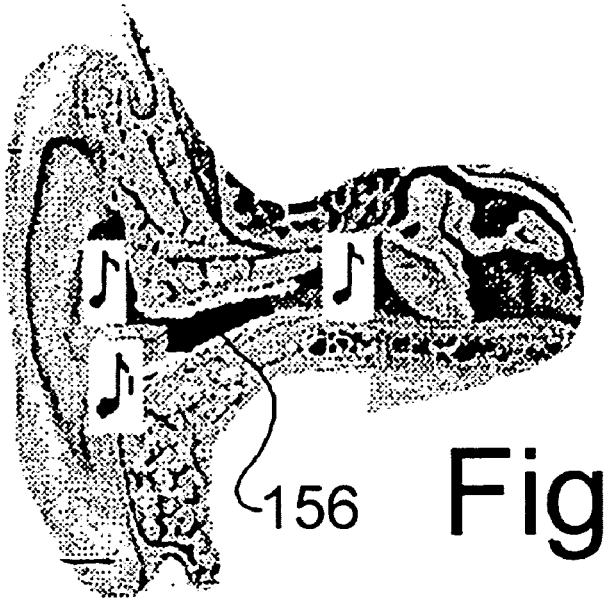
FIG. 57 is another view of a balloon-expandable hearing device fitting system.

Then in step 6 the HCP withdraws saline solution from the balloon 162 back into a syringe to deflate the balloon. (FIG. 54) Then the HCP carefully withdraws the balloon expander 152 and the balloon 162. (FIG. 55). The HCP then deflates the bulb 160 and pulls back the occlusion wire 150. Then the HCP trims the distal end of the ear gel 154 and inserts the hearing aid 156 into the custom shell. (FIG. 56) The hearing aid is then ready for programming and use. (FIG. 57).

The process for using a balloon-expandable system to rapidly fit a hearing aid as described above should be compared to the current process for custom producing a hearing aid. According to the current process a hearing care professional takes an impression of the patient's ear canal with a silicone-based material. The impression solidifies and then is sent to a manufacturer who makes a shell by preparing a negative mold from the impression. Then the manufacturer forms a custom shell by pouring a liquid plastic into the mold.

While embodiments and applications of this invention have been shown and described, it would be apparent to those skilled in the art having the benefit of this disclosure that many more modifications than mentioned above are possible without departing from the inventive concepts herein. The invention, therefore, is not to be restricted except in the spirit of the appended claims.

It should be understood that although the embodiments described herein primarily concern hearing aids, the present invention is also applicable to other ear-worn sub-miniature electronic devices such as telephones, pagers, and other two way communication systems.

What is claimed is:

1. A self-expanding hearing device comprising:

a body;

a membrane adapted to contact a wall of an ear canal, said body being positioned at least partially within said membrane; and, a frame adapted to deploy from a compressed state to a deployed state when warmed above a material activation temperature of said frame, said frame being adapted to cause said membrane to move as said frame deploys.

2. A self-expanding hearing device according to claim 1 wherein said body includes a microphone and a speaker.

3. A self-expanding hearing device according to claim 2 wherein said body is flexible.

4. A self-expanding hearing device according to claim 3 wherein said body comprises a flexible spring.

5. A self-expanding hearing device according to claim 3 wherein said body comprises a flexible Nitinol tube.

6. A self-expanding hearing device according to claim 5 wherein said flexible body is a flexible Nitinol tube with slits.

7. A self-expanding hearing device according to claim 2 wherein said body is formable by a user.

8. A self-expanding hearing device according to claim 2 wherein said body is shaped to conform the ear canal.

9. A self-expanding hearing device according to claim 1 wherein said body is asymmetrically located with respect to said frame.

10. A self-expanding hearing device according to claim 1 wherein said frame includes a plurality of supports.

11. A self-expanding hearing device according to claim 10 wherein said supports are elastic.

12. A self-expanding hearing device according to claim 10 wherein said supports are formed of a superelastic material.

13. A self-expanding hearing device according to claim 12 wherein said superelastic material is Nitinol.

14. A self-expanding hearing device according to claim 10 wherein said supports are constructed and arranged to move independently of each other.

15. A self-expanding hearing device according to claim 10 wherein said supports are springs.

16. A self-expanding hearing device according to claim 15 wherein said springs are constructed of metal.

17. A self-expanding hearing device according to claim 16 wherein said springs are constructed of Nitinol.

18. A self-expanding hearing device according to claim 16 wherein said springs are constructed of Elgiloy.

19. A self-expanding hearing device according to claim 16 wherein said springs are constructed of spring steel.

20. A self-expanding hearing device according to claim 16 wherein said springs are constructed of MP35 alloy.

21. A self-expanding hearing device according to claim 10 wherein said supports are shaped in a spiral configuration.

22. A self-expanding hearing device according to claim 10 wherein said supports are shaped in a mesh configuration.

23. A self-expanding hearing device according to claim 10 wherein said supports are 0.002 to 0.02 inches wide.

24. A self-expanding hearing device according to claim 23 wherein said supports are 0.004 to 0.015 inches wide.

25. A self-expanding hearing device according to claim 24 wherein said supports are 0.005 to 0.01 inches wide.

26. A self-expanding hearing device according to claim 10 wherein said supports are formed of a shape memory material.

27. A self-expanding hearing device according to claim 26 wherein said shape memory material is Nitinol.

28. A self-expanding hearing device according to claim 27 wherein said shape memory material is Nitinol with material activation temperature between 20° C. and 40° C.

29. A self-expanding hearing device according to claim 10 wherein said body has a proximal end and a distal end and said supports are connected to said body by a proximal connector and a distal connector.

30. A self-expanding hearing device according to claim 29 wherein said proximal connector is constructed and arranged to move relative to said body when the user compresses said frame.

31. A self-expanding hearing device according to claim 29 wherein said distal connector is constructed and arranged to move relative to said body when the user compresses said frame.

32. A self-expanding hearing device according to claim 1 wherein the material activation temperature is about 20° C.

33. A self-expanding hearing device according to claim 1 wherein the material activation temperature is above 25° C. and below 37° C.

34. A self-expanding hearing device according to claim 1 wherein said membrane encloses said frame.

35. A self-expanding hearing device according to claim 1 wherein said membrane partially encloses said frame.

36. A self-expanding hearing device according to claim 1 further comprising a sealing fin connected to said membrane.

37. A self-expanding hearing device according to claim 1 wherein said membrane is constructed from elastic material.

38. A self-expanding hearing device according to claim 1 wherein said membrane is constructed from inelastic material.

39. A self-expanding hearing device according to claim 1 wherein said membrane is 0.00025 to 0.2 inches thick.

40. A self-expanding hearing device according to claim 39 wherein said membrane is 0.0005 to 0.05 inches thick.

41. A self-expanding hearing device according to claim 40 wherein said membrane is 0.001 to 0.025 inches thick.

42. A self-expanding hearing device according to claim 1 wherein said membrane comprises at least two zones, and said membrane has a first thickness in the first zone and a second thickness in the second zone.

43. A self-expanding hearing device according to claim 42 wherein the first thickness is smaller than the second thickness.

44. A self-expanding hearing device according to claim 42 wherein the first thickness is between 0.00025 and 0.02 inches.

45. A self-expanding hearing device according to claim 42 wherein the second thickness is between 0.02 and 0.2 inches.

46. A self-expanding hearing device according to claim 1 wherein said membrane is coupled to said frame.

47. A self-expanding hearing device according to claim 1 wherein said membrane is not coupled to said frame.

48. A self-expanding hearing device according to claim 1 wherein said frame is comprised of plurality of sections.

49. A self-expanding hearing device according to claim 48 wherein said frame is comprised of a proximal section, a distal section and a middle section.

50. A self-expanding hearing device according to claim 49 wherein at least two of said sections are substantially different in configuration from each other.

51. A self-expanding hearing device comprising:

a body; and, a frame coupled to said body, said frame being adapted to deploy from a compressed state to a deployed state when warmed above a material activation temperature of said frame, said frame being adapted, in the deployed state, to cause said self-expanding hearing device to at least partially seal to a wall of an ear canal.

52. A self-expanding hearing device according to claim 51 wherein said body includes a microphone and a speaker.

53. A self-expanding hearing device according to claim 51 wherein said body is flexible.

54. A self-expanding hearing device according to claim 51 wherein said frame includes a plurality of supports.

55. A self-expanding hearing device according to claim 54 wherein said supports are elastic.

56. A self-expanding hearing device according to claim 54 wherein said supports are formed of a superelastic material.

57. A self-expanding hearing device according to claim 56 wherein said superelastic material is Nitinol.

58. A self-expanding hearing device according to claim 54 wherein said supports are constructed and arranged to move independently of each other.

59. A self-expanding hearing device according to claim 54 wherein said supports are shaped in a spiral configuration.

60. A self-expanding hearing device according to claim 54 wherein said body has a proximal end and a distal end and said supports are connected to said body by a proximal connector and a distal connector.

61. A self-expanding hearing device according to claim 60 wherein said proximal connector is constructed and arranged to move relative to said body when the user compresses said frame.

62. A self-expanding hearing device according to claim 60 wherein said distal connector is constructed and arranged to move relative to said body when the user compresses said frame.

63. A self-expanding hearing device comprising:

a hearing aid body comprising:

a microphone;

a speaker;

a frame coupled to the body, the frame being adapted to deploy from a compressed state to a deployed state when warmed above a material activation temperature of the frame, the frame being adapted, in the deployed state, to cause the self-expanding hearing device to at least partially conform to an ear canal.

64. A self-expanding hearing device according to claim 63, further comprising a surface adapted to contact an ear canal wall, the surface being coupled to the frame.

65. A self-expanding hearing device according to claim 64, wherein the surface comprises a silicone-based material and the frame comprises a shape memory material.

66. A self-expanding hearing device comprising:

a hearing aid body comprising:

a microphone;

a speaker;

a Nitinol frame, the Nitinol frame being adapted to deploy from a compressed state to a deployed state when warmed by an ear canal;

a silicone surface adapted to expand when the Nitinol frame deploys, the silicone surface being adapted to contact a wall of the ear canal.

67. A self-expanding hearing device comprising:

a hearing aid body comprising:

a microphone;

a speaker;

a Nitinol frame coupled to the body, the Nitinol frame being adapted to deploy from a compressed state to a deployed state when warmed by an ear canal, the Nitinol frame comprising a material activation temperature between 20° C. and 40° C., the Nitinol frame being adapted, as the Nitinol frame deploys, to cause the self-expanding hearing device to expand in a user's ear canal.

* * * * *